US009201379B2

(12) United States Patent
Yuasa

(10) Patent No.: US 9,201,379 B2
(45) Date of Patent: Dec. 1, 2015

(54) IMAGE FORMING APPARATUS WITH LUBRICANT SUPPLY

(71) Applicant: CANON KABUSHIKI KAISHA, Tokyo (JP)

(72) Inventor: Takao Yuasa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/322,230

(22) Filed: Jul. 2, 2014

(65) Prior Publication Data

US 2015/0023682 A1 Jan. 22, 2015

(30) Foreign Application Priority Data

Jul. 19, 2013 (JP) ..... 2013-151084

(51) Int. Cl.
*G03G 15/00* (2006.01)
*G03G 21/00* (2006.01)
*G03G 15/16* (2006.01)

(52) U.S. Cl.
CPC ..... *G03G 21/0094* (2013.01); *G03G 15/161* (2013.01); *G03G 2215/1661* (2013.01)

(58) Field of Classification Search
CPC ..... G03G 15/161; G03G 21/0011; G03G 21/0076; G03G 21/0094; G03G 2216/1661; G03G 2221/001; G03G 2221/0026; G03G 2215/1661
See application file for complete search history.

(56) References Cited

U.S. PATENT DOCUMENTS 5,470,635 A * 11/1995 Shirai et al. ..... 428/131
5,881,339 A 3/1999 Yanagida et al.
5,970,282 A 10/1999 Yanagida et al.
6,032,006 A * 2/2000 Yanagida ..... 399/101
6,141,522 A * 10/2000 Tsuruoka et al. ..... 399/302
6,311,031 B1 * 10/2001 Hirano ..... 399/101
6,347,212 B1 * 2/2002 Kosugi et al. ..... 399/348
7,085,517 B2 * 8/2006 Sameshima ..... 399/111
7,212,777 B2 * 5/2007 Takada et al. ..... 399/350
7,313,343 B2 * 12/2007 Tanaka et al. ..... 399/101

(Continued)

FOREIGN PATENT DOCUMENTS

JP 09-054531 A 2/1997
JP 2002-244485 A 8/2002

(Continued)

OTHER PUBLICATIONS

Search Report issued in European Patent Application No. 14174941.6, dated Jan. 5, 2015.

*Primary Examiner* — David Bolduc
(74) *Attorney, Agent, or Firm* — Fitzpatrick, Cella, Harper & Scinto

(57) ABSTRACT

An image forming apparatus includes an intermediate transfer belt, a driving source commonly and rotationally driving the intermediate transfer belt and a second image carrier, a first cleaning blade rubbing at a first rubbing position, and a second cleaning blade rubbing a second image rubbing position. The image forming apparatus includes a lubricant supplying portion capable of supplying lubricant to the first or second rubbing position, a load detecting portion detecting a driving load of the driving source, and a control portion capable of executing a lubricant supplying mode of supplying lubricant to either one of the first and second rubbing positions on a basis of processing contents of a most recent predetermined number of times of image forming operations in a case where the driving load detected by the load detecting portion exceeds a predetermined value.

11 Claims, 11 Drawing Sheets

(56) References Cited

U.S. PATENT DOCUMENTS

| | | | | |
|---|---|---|---|---|
| 7,653,319 | B2 * | 1/2010 | Yamamoto et al. | 399/44 |
| 2003/0206746 | A1 * | 11/2003 | Bessho et al. | 399/45 |
| 2005/0191099 | A1 * | 9/2005 | Yamaguchi et al. | 399/346 |
| 2006/0127120 | A1 * | 6/2006 | Kinokuni | 399/71 |
| 2006/0203070 | A1 * | 9/2006 | Matsuyama et al. | 347/116 |
| 2007/0116483 | A1 * | 5/2007 | Kobayashi et al. | 399/49 |
| 2007/0183824 | A1 * | 8/2007 | Suda et al. | 399/346 |
| 2007/0280734 | A1 * | 12/2007 | Yahagi | 399/167 |
| 2008/0131180 | A1 * | 6/2008 | Kishi | 399/346 |
| 2008/0145076 | A1 * | 6/2008 | Mochizuki | 399/55 |
| 2009/0169236 | A1 * | 7/2009 | Fukao et al. | 399/99 |
| 2010/0080625 | A1 * | 4/2010 | Furuya et al. | 399/121 |
| 2010/0272460 | A1 * | 10/2010 | Zona et al. | 399/71 |
| 2011/0013919 | A1 * | 1/2011 | Matsuda | 399/49 |
| 2011/0044724 | A1 * | 2/2011 | Funamoto et al. | 399/167 |
| 2011/0064452 | A1 * | 3/2011 | Mizusawa | 399/101 |
| 2011/0150547 | A1 * | 6/2011 | Hirata | 399/350 |
| 2011/0229187 | A1 * | 9/2011 | Hozumi et al. | 399/101 |
| 2011/0268463 | A1 * | 11/2011 | Kimura et al. | 399/53 |
| 2011/0268466 | A1 * | 11/2011 | Kimura et al. | 399/71 |
| 2012/0020692 | A1 * | 1/2012 | Thayer et al. | 399/71 |
| 2012/0063826 | A1 | 3/2012 | Ohmori et al. | |
| 2012/0275807 | A1 * | 11/2012 | Kanari et al. | 399/58 |
| 2013/0016996 | A1 | 1/2013 | Yuasa | |
| 2013/0017006 | A1 * | 1/2013 | Suda | 399/346 |
| 2013/0058668 | A1 * | 3/2013 | Murakami et al. | 399/44 |
| 2013/0071163 | A1 * | 3/2013 | Watanabe et al. | 399/346 |
| 2013/0142529 | A1 * | 6/2013 | Morimoto | 399/53 |
| 2013/0315642 | A1 * | 11/2013 | Nakai et al. | 399/346 |
| 2014/0314431 | A1 * | 10/2014 | Morihara et al. | 399/46 |
| 2014/0334836 | A1 * | 11/2014 | Yoshiyama et al. | 399/53 |

FOREIGN PATENT DOCUMENTS

| | | | |
|---|---|---|---|
| JP | 3330791 | B2 | 9/2002 |
| JP | 2004-258419 | A | 9/2004 |
| JP | 2005-106920 | A | 4/2005 |
| JP | 2005-266248 | A | 9/2005 |
| JP | 4516771 | B2 | 8/2010 |
| JP | 2011-197075 | A | 10/2011 |
| JP | 2012-083729 | A | 4/2012 |
| JP | 2013-37355 | A | 2/2013 |
| JP | 5455058 | B2 | 3/2014 |

* cited by examiner

IMAGE FORMING APPARATUS WITH LUBRICANT SUPPLY

BACKGROUND OF THE INVENTION

1. Field of the Invention

The present invention relates to an image forming apparatus such as a printer and a copier.

2. Description of the Related Art

Hitherto, there have been known various image forming apparatuses adopting electro-photographic or electrostatic recording system in their image forming process, and as one example of these various image forming apparatuses, there is a tandem type image forming apparatus in which a plurality of process cartridges is arrayed in a row along a rotational direction of an intermediate transfer belt rotatably stretched and which is configured to form a color image through the intermediate transfer belt.

This type of full-color image forming apparatus includes a photoconductor cleaning blade removing residual toner left on the photoconductive drum (image carrier) after a primary transfer and a second cleaning blade removing residual toner left on the intermediate transfer belt after a secondary transfer.

As such a cleaning blade, a counter-type cleaning blade made of an elastic material such as rubber is brought into contact so as to face in a driving direction is adopted in general. This counter-type blade cleaning is known to cause a problem called turn-up of the blade in a case where friction forces between the cleaning blade and the photoconductive drum and between the cleaning blade and the intermediate transfer belt increase.

Then, conventionally, Japanese Patent Application Laid-open Nos. 2004-258419 and 2005-106920 disclose to avoid the occurrence of the turn-up of the blade or the like by supplying lubricant to nip portions between the cleaning blade and the photoconductive drum and the cleaning blade and the intermediate transfer belt to reduce the friction forces.

Specifically, Japanese Patent Application Laid-open No. 2004-258419 discloses to detect a driving torque of a photoconductive drum by a current detecting portion, and based on the detection result, to determine an abnormality of the cleaning blade of a cleaning unit, and to supply lubricant toner to avoid the abnormality.

Japanese Patent Application Laid-open No. 2005-106920 discloses to change a length in a sub-scan direction of a toner belt in a case where a print set number is less than a first reference value. That is, JPA No. 2005-106920 discloses to change the length in the sub-scan direction of the toner belt corresponding to a total number of pixels drawn into a predetermined length of an area from both ends of the cleaning blade during preparation of a most recent total number within a second reference value of prints and to an intra-apparatus temperature just before forming the toner belt.

By the way, while both JPA Nos. 2004-258419 and 2005-106920 describe the image forming apparatuses configured to prevent turn-up of the blade from occurring by supplying lubricant toner for the cleaning blade cleaning the photoconductive drum, there is a case where such cleaning blade is provided for the intermediate transfer belt as described in JPA No. 2005-106920.

In such a case, if a friction between the cleaning blade and the intermediate transfer belt increases, there is a possibility that the turn-up of the cleaning blade cleaning the intermediate transfer belt occurs as well. However, no consideration is made concerning the possibility of causing the turn-up of the cleaning blade for the intermediate transfer belt in the image forming apparatuses described in JPA Nos. 2004-258419 and 2005-106920.

SUMMARY OF THE INVENTION

According to a first aspect of the present invention, an image forming apparatus includes first and second rotatably supported image carriers, an intermediate transfer belt rotatably conveying a toner image transferred thereto, a driving source rotationally driving both the intermediate transfer belt and the second image carrier, a first cleaning blade rubbing the intermediate transfer belt at a first rubbing position, a second cleaning blade rubbing the second image carrier at a second rubbing position, a lubricant supplying portion configured to be able to supply lubricant to the first or second rubbing position, a load detecting portion configured to detect a driving load of the driving source, and a control portion configured to be able to execute a lubricant supplying mode of supplying lubricant to either one of the first and second rubbing positions on a basis of processing contents of a most recent predetermined number of times of image forming operations in a case where the driving load detected by the load detecting portion exceeds a predetermined value.

According to a second aspect of the present invention, an image forming apparatus includes first and second rotatably supported image carriers, an intermediate transfer belt rotatably conveying a toner image transferred thereto, a driving source rotationally driving both the intermediate transfer belt and the second image carrier, a clutch portion connecting/disconnecting the transmission of the drive from the driving source to either one of the intermediate transfer belt and the second image carrier, a first cleaning blade rubbing the intermediate transfer belt at a first rubbing position, a second cleaning blade rubbing the second image carrier at a second rubbing position, a lubricant supplying portion configured to be able to supply lubricant to the first or second rubbing position, a load detecting portion configured to detect a driving load of the driving source, and a control portion configured to be able to execute a lubricant supplying mode in a case where the driving load detected by the load detecting portion exceeds a first predetermined value and supplying the lubricant to either one of the first and second rubbing positions on a basis of a result obtained by detecting the driving load of the driving source again by the load detecting portion in a state in which either one of the intermediate transfer belt and the second image carrier is disconnected from the driving source by the clutch portion.

Further features of the present invention will become apparent from the following description of exemplary embodiments with reference to the attached drawings.

DESCRIPTION OF THE EMBODIMENTS

First Embodiment

Figure 1:
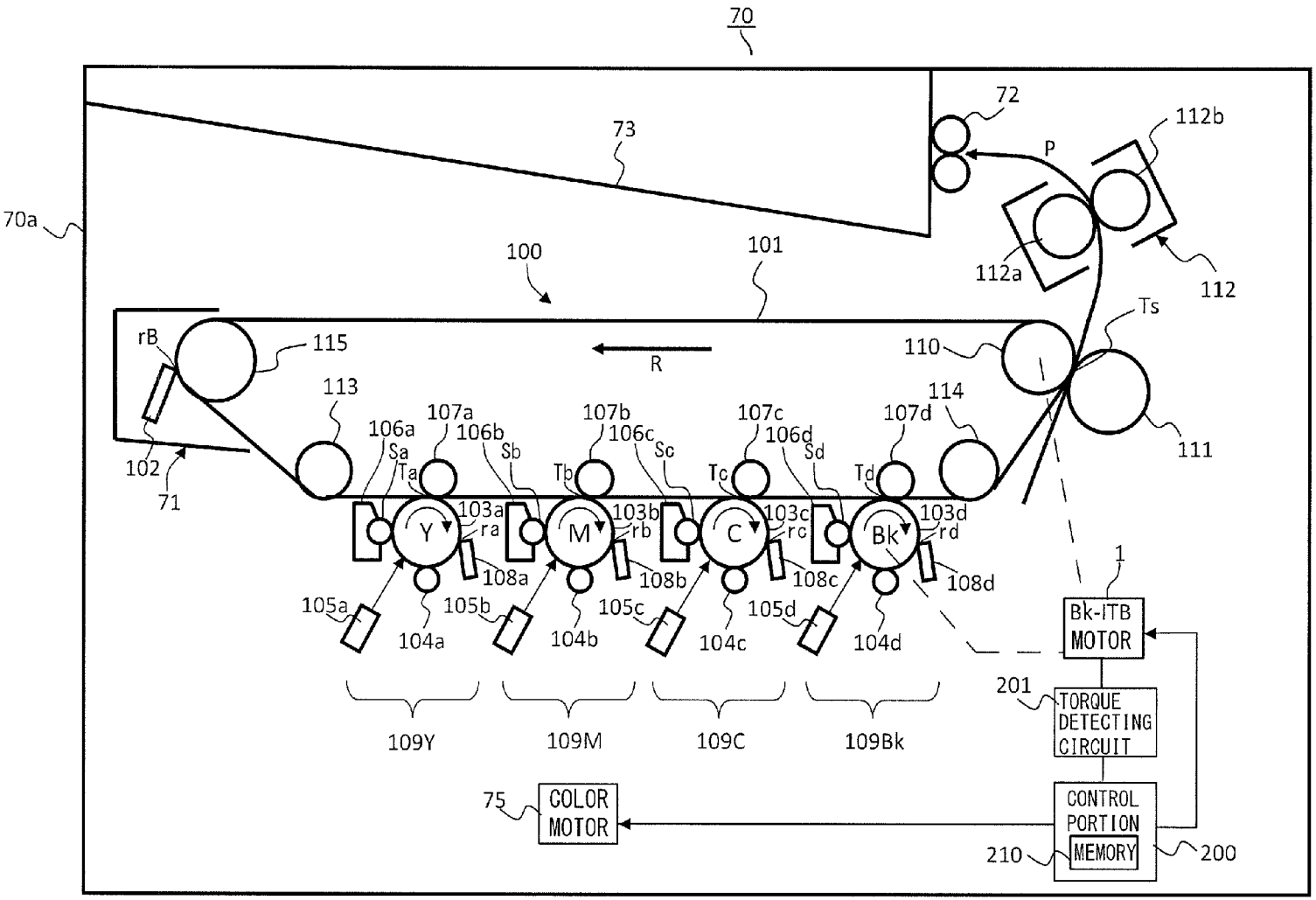
FIG. 1 is a schematic section view illustrating a schematic configuration of an image forming apparatus according embodiments of the present invention.

An embodiment of the present invention will be described in detail with reference to the drawings. A same reference numeral denotes a same or corresponding part throughout several views. It is noted that while a main part concerning formation and transfer of a toner image will be explained in the present embodiment, the present invention is applicable also to various uses such as various printers, copiers, facsimiles and multi-function printers by adding required devises, units and a case structure.

[Image Forming Apparatus]

An image forming apparatus 70 of the present embodiment will be described with reference to FIG. 1. FIG. 1 is a schematic section view illustrating a schematic structure of the image forming apparatus 70 such as a tandem-type intermediate transfer type full-color printer of the present embodiment.

As shown in FIG. 1, the image forming apparatus 70 has an apparatus body 70*a*, and an intermediate transfer belt unit 100 having an intermediate transfer belt (ITB) 101 is disposed at a vertically middle stage position within the apparatus body 70*a*. The intermediate transfer belt unit 100 includes image forming portions 109Y, 109M, 109C and 109Bk arrayed in order from upstream in a conveying direction along a lower conveying face of the intermediate transfer belt 101. These image forming portions 109Y through 109Bk form toner images of respective colors of yellow (Y), magenta (M), cyan (C) and black (Bk) to the intermediate transfer belt 101 that is driven and conveyed.

The image forming portions 109Y through 109 respectively include a drum-shaped electro-photographic body (referred to as a "photoconductive drum" hereinafter) 103*a* through 103*d* as latent image carriers. The photoconductive drums 103*a* through 103*d* are configured to be driven and to rotate in a direction of an arrow (clockwise) shown in FIG. 1. It is noted that the photoconductive drums 103*a*, 103*b*, and 103*c* compose a first image carrier rotatably supported and the photoconductive drum 103*d* composes a second image carrier rotatably supported.

The intermediate transfer belt unit 100 includes a driving roller 110 that functions also as a secondary transfer inner roller, stretching rollers 113 and 114, and a tension roller 115, which are disposed respectively in a predetermined positional relationship. The endless intermediate transfer belt 101 is stretched (supported) so as to be able to rotate in a circumferential direction (in a direction of an arrow R) by these rollers 110, 113, 114, and 115, and rotates and conveys the toner image transferred thereto. A tension force toward an outside is applied to the intermediate transfer belt 101 by the tension roller 115.

Primary transfer rollers 107*a*, 107*b*, 107*c*, and 107*d* are disposed between the stretch rollers 113 and 114 on an inner circumferential side of the intermediate transfer belt 101. A transfer bias is applied to each of these primary transfer rollers 107*a* through 107*d* respectively by a bias applying portion not shown. The photoconductive drums 103*a* through 103*d* are disposed at positions respectively facing to the primary transfer rollers 107*a* through 107*d* while interposing the intermediate transfer belt 101 therebetween. The primary transfer rollers 107*a* through 107*d* press a back side (inner face side) of the intermediate transfer belt 101 and a surface thereof is in contact with the photoconductive drums 103*a* through 103*d* respectively in the image forming portions 109Y through 109Bk.

Primary transfer nip portions Ta, Tb, Tc, and Td are formed between the photoconductive drums 103*a* through 103*d* and the intermediate transfer belt 101 respectively as primary transfer portions. The intermediate transfer belt 101 is rotated counterclockwise by the counterclockwise rotation of the driving roller 110 that also functions as the secondary transfer inner roller. Rotational speed of the intermediate transfer belt 101 is set to be substantially equal to rotational speed (process speed) of the respective photoconductive drums 103*a* through 103*d*. The photoconductive drums 103*a* through 103*c*, the first image carrier, the primary transfer portions Ta through Tc will be referred also as a first primary transfer portion. The photoconductive drum 103*d*, the second image carrier and the primary transfer portion Td will be also referred to as a second primary transfer portion.

Disposed around each of the photoconductive drums 103*a* through 103*d* are, in order along a rotational direction thereof, primary charging roller 104*b*, 104*b*, 104*c*, 104*d*, and exposure units 105*a*, 105*b*, 105*c*, and 105*d*. Disposed also around the photoconductive drums 103*a* through 103*d* are developing units 106*a*, 106*b*, 106*c*, and 106*d*, and photoconductor cleaning blades 108*a*, 108*b*, 108*c*, and 108*d*. The developing units 106*a* through 106*d* have developing sleeves Sa, Sb, Sc and Sd, respectively.

Rubbing portions ra, rb, rc and rd of edges of the respective blades rubbing the surfaces of the photoconductive drums 103*a* through 103*d* to scrape the transfer residual toner and others on the drums are formed respectively between the photoconductor cleaning blades 108*a* through 108*d* and the corresponding photoconductive drums 103*a* through 103*d*. It is noted that the photoconductor cleaning blade 108*d* composes a second cleaning blade rubbing the photoconductive drum 103*d* by the rubbing portion rd (second rubbing position) so as to remove the toner on the photoconductive drum 103*d* (second image carrier).

Image signals of yellow, magenta, cyan, and black are inputted respectively to exposure units 105*a* through 105*d*, and corresponding to the image signals, the exposure units 105*a* through 105*d* irradiates laser beams to the respective surfaces of the photoconductive drums 103*a* through 103*d* to neutralize the charges and to form electrostatic latent images.

A secondary transfer outer roller 111 is disposed at a position facing the driving roller 110 on the surface of the intermediate transfer belt 101. The secondary transfer outer roller 111 nips the intermediate transfer belt 101 between the secondary transfer outer roller 111 and the driving roller 110, and Ts, i.e., a secondary transfer portion, is formed between the secondary transfer outer roller 111 and the intermediate transfer belt 101.

The secondary transfer portion Ts secondarily transfers the toner image formed on the intermediate transfer belt 101 to a recording medium (sheet) P sent from a feeding portion not shown. A positive polarity bias is applied to the secondary transfer outer roller 111 of the secondary transfer portion Ts. The four color toner images on the intermediate transfer belt 101 are secondarily transferred to the recording medium P conveyed thereto by a registration roller not shown by the positive polarity bias applied to the secondary transfer portion Ts through the secondary transfer outer roller 111.

Still further, a belt cleaning blade 102 of a belt cleaning unit 71 is disposed at a position facing to the tension roller 115 such that it is in contact with the surface of the intermediate transfer belt 101. A rubbing portion rB of the belt cleaning blade 102 scraping transfer residual toner and others on the intermediate transfer belt 101 by rubbing an edge of the belt cleaning blade 102 is formed between the belt cleaning blade 102 and the intermediate transfer belt 101 on the tension roller 115. It is noted that the belt cleaning blade 102 composes a first cleaning blade rubbing the intermediate transfer belt 101 at the rubbing portion rB (first rubbing position) to remove the toner on the intermediate transfer belt 101.

A fixing unit 112 including a fixing roller 112*a* and a pressure roller 112*b* is disposed downstream in the recording medium conveying direction of the secondary transfer portion Ts. A discharge roller pair 72 and a discharge tray 73 are disposed further downstream of the fixing unit 112.

The recording medium P on which the toner images have been secondarily transferred at the secondary transfer portion Ts is conveyed to a fixing nip portion between the fixing roller 112*a* and the pressure roller 112*b* to be heated and pressed by the fixing roller 112*a* and the pressure roller 112*b* such that the toner images are melted and fixed on the surface of the recording medium P.

The feeding portion not shown including a sheet feed cassette not shown in which recording media to be supplied to form images are stacked is disposed at an under part of the apparatus body 70*a*. The recording media are fed sequentially by a sheet feed roller and others not shown to be conveyed to the registration roller pair.

The apparatus body 70*a* includes a control portion 200 including a ROM, a RAM and a memory. A Bk-ITB motor 1, a torque detecting circuit 201 and a color motor 75 are connected to the control portion 200.

[Operation of Image Forming Apparatus]

In the image forming apparatus 70 constructed as described above, a yellow toner image is formed on the photoconductive drum and is transferred to the intermediate transfer belt 101 in an image forming portion 109Y. A magenta toner image is formed in the same manner with the image forming portion 109Y on the photoconductive drum and is transferred and superimposed on the yellow toner image on the intermediate transfer belt 101 in an image forming portion 109M. Cyan and black toner images are formed in the image forming portions 109C and 109Bk in the same manner with the image forming portion 109Y and are sequentially transferred and superimposed on the intermediate transfer belt 101.

The four color toner images carried on the intermediate transfer belt 101 are conveyed to the secondary transfer portion Ts to be secondarily transferred collectively to the recording medium P. The recording medium P on which the four color toner images have been secondarily transferred is curvature-separated from the intermediate transfer belt 101 and is sent to the fixing unit 112. The fixing unit 112 heats and presses the recording medium P by the fixing roller 112*a* and the pressure roller 112*b* to melt the toner to fix the image on the surface of the recording medium P. After that, the recording medium P is discharged to the discharge tray 73 through the discharge roller pair 72.

[Detail of Image Forming Portion]

The image forming portions 109Y through 109Bk are constructed substantially in the same manner except that the colors of the toners used in the developing units 106*a* through 106*d* are different as yellow, magenta, cyan, and black. Then, a toner image forming process of the image forming portion 109Bk of black will be described in the following explanation and an overlapped description concerning other image forming portions 109Y, 109M, and 109C will be omitted here.

That is, the photoconductive drum 103*d* in the image forming portion 109Bk forms a photoconductive layer whose charge polarity is negative on the surface thereof and rotates in the direction of the arrow with predetermined processing speed.

The charge roller 104*d* negatively charges the surface of the photoconductive drum 103*d* by applying a vibration voltage as an AC voltage superimposed with a negative polarity DC voltage. The exposure unit 105*d* draws an electrostatic image on the surface of the photoconductive drum 103*d* by scanning a laser beam obtained by ON-OFF modulating scan line image data obtained by developing a color separated image of black by a polygonal mirror.

The developing unit 106*d* frictionally electrifies two-component developer containing non-magnetic toner whose charging polarity is negative and magnetic carrier and conveys the toner to a part facing the photoconductive drum 103*d* by carrying by the development sleeve Sd. The toner negatively charged is transferred to an exposed part of the photoconductive drum 103*d* which has become relatively positive by the vibration voltage in which the AC voltage superimposed with the negative DC voltage is applied to the development sleeve Sd and thus, the electrostatic image is reversely developed.

The primary transfer roller 107*d* forms the primary transfer portion Td between the photoconductive drum 103*d* and the intermediate transfer belt 101. The toner image carried on the photoconductive drum 103*d* is primarily transferred to the intermediate transfer belt 101 by applying a positive polarity DC voltage to the primary transfer roller 107*d*. The photoconductor cleaning blade 108*d* is in contact with the photoconductive drum 103*d* and recovers the transfer residual toner left on the photoconductive drum 103*d*.

The secondary transfer outer roller 111 is in contact with an outer surface of the intermediate transfer belt 101 between the image forming portion 109Bk to the belt cleaning blade 102 in the toner image conveying direction. The secondary transfer outer roller 111 composes the secondary transfer portion Ts by being in contact with the outer surface of the intermediate transfer belt 101 whose inner surface is supported by the driving roller 110 that functions also as the secondary transfer inner roller.

The full-color toner image carried on the intermediate transfer belt 101 is secondarily transferred to the recording medium P by applying a positive polarity DC voltage to the secondary transfer outer roller 111. The belt cleaning blade 102 is in contact with the intermediate transfer belt 101 while facing to the tension roller 115 to recover the transfer residual toner left on the intermediate transfer belt 101.

The intermediate transfer belt 101 is an endless belt driven and conveyed in the direction of the arrow R as described above, and is stretched around the driving roller 110, the stretch rollers 113 and 114 and the tension roller 115 that applies a predetermined tension to the intermediate transfer belt 101. It is noted that a number of rollers stretching the intermediate transfer belt 101 is not limited to the configuration shown in FIG. 1.

[Detail of Cleaning Blade]

Urethane rubber having a JIS-A hardness of rubber hardness of 73° is used as a material of the photoconductor cleaning blades 108*a* through 108*d* in the present embodiment. The photoconductor cleaning blades 108*a* through 108*d* are configured such they are in contact so as to face in the rotational direction of the respective photoconductive drums 103*a* through 103*d* with a set angle of 25° and a contact pressure of 35 N/m. However, the present invention is not limited to such configuration.

A material of the belt cleaning blade 102 is urethane rubber having a JIS-A hardness of rubber hardness of 77°. The belt cleaning blade 102 is configured such that it is in contact so as to face in the rotational direction of the tension roller 115 (the intermediate transfer belt 101) with a set angle of 25° and a contact pressure of 30 N/m. However, the present invention is not limited to such configuration.

[Driving Configuration of Image Forming Apparatus]

Figure 3A:
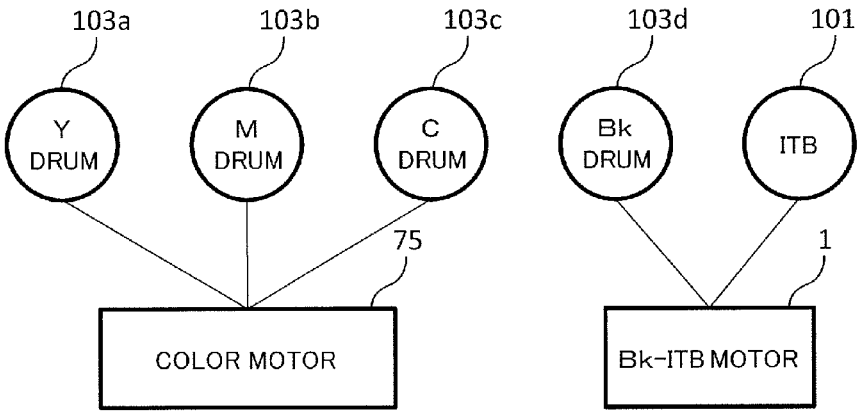
FIG. 3A is a diagram illustrating a configuration in driving photoconductive drums and an intermediate transfer belt of the first embodiment.

In order to cut a cost of the image forming apparatus 70, the image forming apparatus 70 is configured such that the photoconductive drums 103*a* (Y drum), 103*b* (M drum), and 103*c* (C drum) are rotationally driven by the common color motor 75 as shown in FIGS. 1 and 3A in the present embodiment. The photoconductive drum 103*d* (Bk drum) and the intermediate transfer belt 101 (the driving roller 110) are also commonly rotationally driven by the Bk-ITB motor 1. It is noted that the Bk-ITB motor 1 composes a driving source commonly and rotationally driving the intermediate transfer belt 101 and the photoconductive drum 103*d* (second image carrier).

Figure 3B:
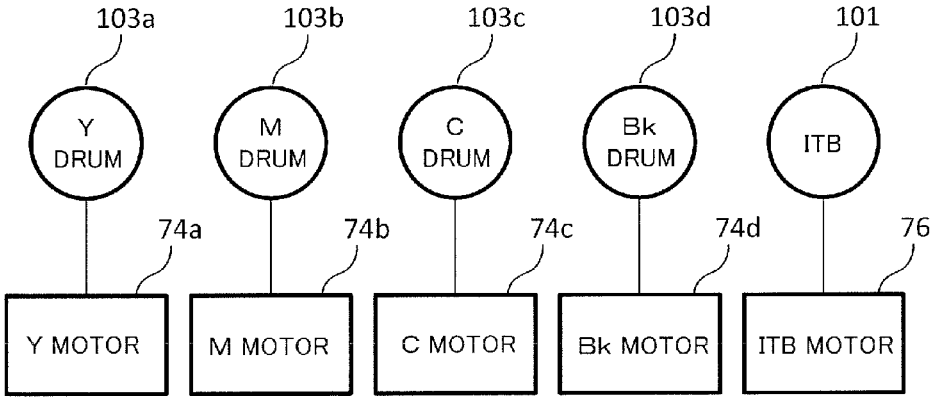
FIG. 3B is a diagram schematically illustrating a configuration in a case where the photoconductive drums and the intermediate transfer belt are driven by different motors.

As shown in FIG. 3B, this configuration makes it possible to reduce a number of motors from five to two as compared to the configuration in which the photoconductive drums 103*a* through 103*d* and the intermediate transfer belt 101 (the driving roller 110) are driven by the other motors. The other motors are a Y motor 74*a*, a M motor 74*b*, C a motor 74*c*, and a Bk motor 74*d*, and an ITB motor 76. Thus, the considerable cut of the cost of the image forming apparatus 70 is realized by the present embodiment.

[Driving Torque of Bk-ITB Motor]

The present embodiment includes the torque detecting circuit 201 detecting a driving torque (driving load) of the Bk-ITB motor 1, i.e., the driving source. It is noted that although the configuration of the torque detecting circuit 201 is not specifically limited, the torque detecting circuit 201 of the present embodiment adopts a method of detecting a driving current of the Bk-ITB motor 1 and converting its detected value into the driving torque by utilizing that the motor driving torque and the current value are proportional.

As described above, if the friction forces between the cleaning blade and the photoconductive drum and between the cleaning blade and the intermediate transfer belt increase, such problems that chipping and turn-up of the cleaning blade occur. It is possible to prevent such problem by supplying lubricant to rubbing portions (nip portions) between the cleaning blade and the photoconductive drum and between the cleaning blade and the intermediate transfer belt. A toner belt is supplied as the lubricant in the present embodiment. This 'toner belt' is what is formed as a belt-like toner image formed in a width direction of the intermediate transfer belt 101 by either one of the image forming portions 109Y through 109Bk (the image forming portion 109Bk in the present embodiment).

In the present embodiment, the friction forces between the cleaning blade and the photoconductive drum and between the cleaning blade and the intermediate transfer belt are detected as driving torques of the motor and the toner belt is supplied as lubricant in a case where the driving torque exceeds a predetermined threshold value.

The driving torque Tr of the Bk-ITB motor 1 fluctuates largely in scraping the transfer residual toner by the photoconductor cleaning blade 108*d* and the belt cleaning blade 102, so that it is desirable to detect the driving torque Tr during a pre-rotation time before forming an image or during a post-rotation time after forming an image. It is also possible to provide a torque detecting mode for detecting the driving torque Tr of the Bk-ITB motor 1 by interrupting an image forming operation.

[Correlation Between Driving Torque and Number of Times of Image Forming Operations]

Here, a correlation between the driving torque Tr and a number of times of image forming operations (number of image formed recording media during an endurance test) will be explained. It is noted that FIGS. 4A through 4C are graphs illustrating the driving torque Tr of the Bk-ITB motor 1.

Figure 4A:
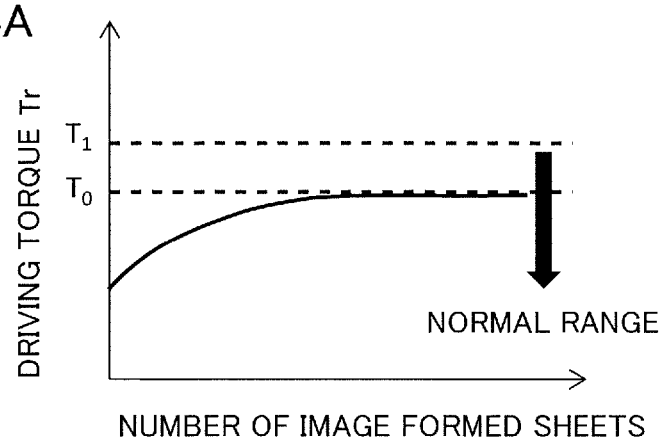
FIG. 4A is a graph illustrating a driving torque of a Bk-ITB motor in a case where lubricant steadily exists.

As shown in FIG. 4A, in a case where the lubricant stationary exists at the rubbing portion rB between the belt cleaning blade 102 and the intermediate transfer belt 101 and at the rubbing portion rd between the photoconductor cleaning blade 108*d* and the photoconductive drum 103*d*, the driving torque Tr turns out as follows. That is, in the case where toner or external additive, i.e., the lubricant, stationarily exists at the rubbing portions rB and rd, the driving torque Tr of the Bk-ITB motor 1 moderately increases corresponding to the number of times of image forming operations and saturates substantially to a certain value T0 (saturation value T0 lower than a threshold value T1).

Figure 4B:
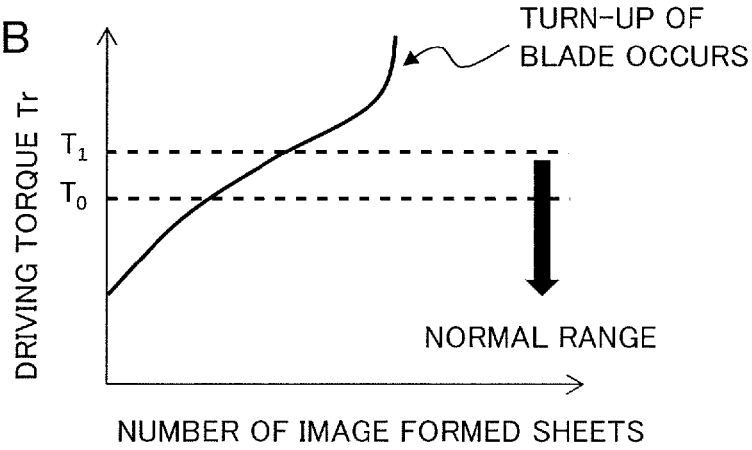
FIG. 4B is a graph illustrating the driving torque of the Bk-ITB motor in a case where turn-up of a blade occurs.

However, if the image forming operations of forming images consuming less toner such as solid white images are repeated, the driving torque Tr of the Bk-ITB motor 1 increases sharply as shown in FIG. 4B. This ends up causing turn-up of the belt cleaning blade 102 and the photoconductor cleaning blade 108*d*.

Figure 4C:
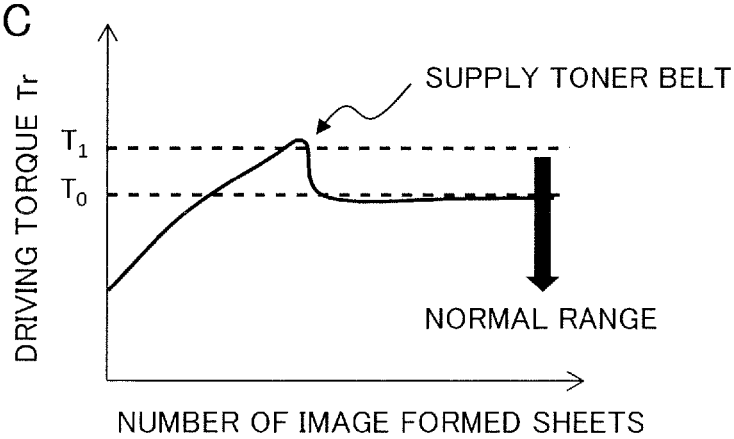
FIG. 4C is a graph illustrating the driving torque of the Bk-ITB motor in a case where a toner belt is supplied to a rubbing portion when the driving torque exceeds a threshold value.

When the driving torque Tr exceeds the threshold value $T_1$ as shown in FIG. 4C, the toner belt is supplied to the rubbing portion rB between the belt cleaning blade 102 and the intermediate transfer belt 101 and to the rubbing portion rd between the photoconductor cleaning blade 108*d* and the photoconductive drum 103*d*. Thereby, the driving torque Tr of the Bk-ITB motor 1 decreases below the saturation value $T_0$ and is stabilized at the saturation value $T_0$ after that.

The inventors et al. found that the saturation value $T_0$ of the driving torque Tr of the Bk-ITB motor 1 is around 0.04 to 0.045 kgf·m (0.392 to 0.441 N/m). The inventors et al. also found that the turn-up of the belt cleaning blade 102 and the photoconductor cleaning blade 108*d* tend to frequently occur when the driving torque Tr of the Bk-ITB motor 1 increases more than 0.06 kgf·m (0.588 N/m).

Then, the threshold value $T_1$ of the driving torque Tr of the Bk-ITB motor 1 will be set at 0.05 kgf·m (0.490 N/m) by considering also chipping of the belt cleaning blade 102 and the photoconductor cleaning blade 108*d* in the present embodiment. However, the present invention is not limited to these specific numerical values.

[Lubricant Supplying Portion]

The toner belt is supplied as the lubricant to the rubbing portion rB between the intermediate transfer belt 101 and the belt cleaning blade 102 and to the rubbing portion rd between the photoconductive drum 103*d* and the photoconductor cleaning blade 108*d* in the present embodiment. It is noted that the image forming portion 109Bk or more specifically the developing unit 106*d* of the image forming portion 109Bk of the present embodiment composes a lubricant supplying portion capable of supplying the lubricant to the rubbing portion rB, i.e., a first rubbing position, or to the rubbing portion rd, i.e., a second rubbing position.

A case of forming the toner belt as the lubricant in the image forming portion 109Bk will be exemplified and explained. It is noted that it is also possible to provide a different lubricant supplying portion and to use powder lubricant and liquid lubricant other than the toner. Still further, the lubricant supplying portion may be configured so as to include not only the image forming portion 109Bk, but also at least one of the developing units 106*a* through 106*c* of the other image forming portions 109Y, 109M and 109C.

The toner belt used as the lubricant is formed in an entire range of a developing width of the developing unit 106*d*. In a case when the toner belt is supplied to the rubbing portion rd, a DC voltage of inverse polarity from that in forming an image is applied to the primary transfer roller 107*d*. It is possible to supply the toner belt thus formed effectively to the rubbing portion rd by reducing an amount to be primarily transferred to the intermediate transfer belt 101. It is noted that a DC voltage of an inverse polarity from that in forming an image is applied also to the secondary transfer outer roller 111 to prevent the secondary transfer outer roller 111 from being contaminated by the toner.

Meanwhile, in a case where the toner belt is supplied to the rubbing portion rB between the belt cleaning blade 102 and the intermediate transfer belt 101, a DC voltage of the same polarity with that in forming an image is applied to the primary transfer roller 107*d* and a DC voltage of an inverse polarity from that in forming an image is applied to the secondary transfer outer roller 111. This arrangement makes it possible to supply the toner belt thus formed to the rubbing portion rB effectively bypassing, without adhering, the secondary transfer outer roller 111 and to prevent the secondary transfer outer roller 111 from being contaminated by the toner.

As described above, in a case of supplying the lubricant to the rubbing portion rB (first rubbing position), the control portion 200 applies the primary transfer bias having the same polarity with that in normally forming an image to the primary transfer roller 107*d* in the present embodiment. In the same time, the control portion 200 controls such that the secondary transfer bias having the inverse polarity from that in normally forming an image is applied to the secondary transfer outer roller 111. Still further, in a case of supplying the lubricant to the rubbing portion rd (second rubbing position), the control portion 200 controls such that the primary transfer bias and the secondary transfer bias having the inverse polarity from that in normally forming an image are applied respectively to the primary transfer roller 107*d* and the secondary transfer outer roller 111. These controls are made in the same manner also in second through fifth embodiments described later.

It is noted that while a color of the toner belt supplied to the rubbing portion rB may be any color of yellow, magenta, cyan and black, a black toner belt formed in the image forming portion 109Bk will be supplied in the present embodiment.

A toner loading amount of the toner belt is 0.5 mg/cm$^2$ and a length in the conveying direction of the toner belt is 10 mm in the present embodiment. Set values of the DC voltages applied to the primary transfer roller 107*d* and the secondary transfer outer roller 111 in forming an image are 900 V and 1500 V, respectively.

Set values of the DC voltages of the inverse polarity from that in forming an image and applied to the primary transfer roller 107*d* and the secondary transfer outer roller 111 in supplying the toner belt are −500 V and −300 V, respectively, in the present embodiment. However, the present invention is not limited to these specific numerical values.

Next, a configuration for giving priority to the photoconductor cleaning blade 108*d* and the belt cleaning blade 102 in the present embodiment will be explained in detail.

That is, it is difficult to individually measure the driving torque of the photoconductive drum and the driving torque of the intermediate transfer belt in the configuration in which the photoconductive drum 103Bk and the intermediate transfer belt 101 are commonly driven by the Bk-ITB motor 1 in the present embodiment, so that it is difficult to accurately determine which one of the photoconductor cleaning blade 108*d* and the belt cleaning blade 102 requires the supply of the toner belt from the driving torque of the Bk-ITB motor 1. That is, it is unable to determine which one of the photoconductor cleaning blade 108*d* and the belt cleaning blade 102 requires the supply of the toner belt in the case where the driving torque Tr of the Bk-ITB motor 1 exceeds the threshold value $T_1$ set in advance. Still further, if the lubricant (toner) is supplied to both of the photoconductor cleaning blade 108*d* and the belt cleaning blade 102 always when the driving torque Tr of the Bk-ITB motor 1 exceeds the threshold value $T_1$ set in advance, the lubricant is supplied also to the cleaning blade which originally requires no lubricant. Thus, the lubricant is consumed wastefully and a life of the image forming portion 109Bk (the developing unit 106*d*) is shortened.

Accordingly, in order to suppress the unnecessary toner consumption and to supply the lubricant efficiently, it is necessary to give the priority to the photoconductor cleaning blade 108*d* and the belt cleaning blade 102 by setting criteria other than the driving torque Tr of the Bk-ITB motor 1.

In the present embodiment, a rate of full-color images in a most recent predetermined number of times of image forming operations performed in the image forming apparatus 70 (referred to as a 'full-color rate1' (a rate of execution of a full-color mode) hereinafter) will be adopted as the criteria in the present embodiment.

As described above, the photoconductor cleaning blade 108*d* scrapes the transfer residual toner left on the photoconductive drum 103*d* without being transferred to the intermediate transfer belt 101 in the first transfer portion (second primary transfer portion) Td.

The belt cleaning blade 102 also scrapes the transfer residual toner left on the intermediate transfer belt 101 without being secondarily transferred to the recording medium P in the secondary transfer portion Ts. The belt cleaning blade 102 scrapes the four colors of transfer residual toners from the image forming portions 109Y, 109M, 109C, and 109Bk in forming a full-color image and scrapes the transfer residual toner of one color from the image forming portion 109Bk in forming a white and black image.

Accordingly, the toner tends to be depleted more at the rubbing portion rd between the photoconductor cleaning blade 108*d* and the photoconductive drum 103*d* than the rubbing portion rB between the belt cleaning blade 102 and the intermediate transfer belt 101 in forming a full-color image. Therefore, in a case where the most recent color rate (rate of execution of the full-color mode) is high, the toner belt is supplied in priority to the rubbing portion rd. Meanwhile, in a case where the most recent color rate is low, the toner belt is supplied in priority to the rubbing portion rB in the present embodiment even though it is possible to give the priority to either one of the rubbing portions rd and rB.

The priority level of the supply of the toner belt to the rubbing portions rd and rB is determined based on the color rate of a most recent 100 images when the driving torque Tr of the Bk-ITB motor 1 exceeds the threshold value $T_1$ in the present embodiment. For instance, in a case where the color rate is 20% or more, the priority is given to the rubbing portion rd of the photoconductor cleaning blade 108*d* and in a case where the color rate is less than 20%, the priority is given to the rubbing portion rB of the belt cleaning blade 102. However, the present invention is not limited to these specific numerical values.

Figure 5:
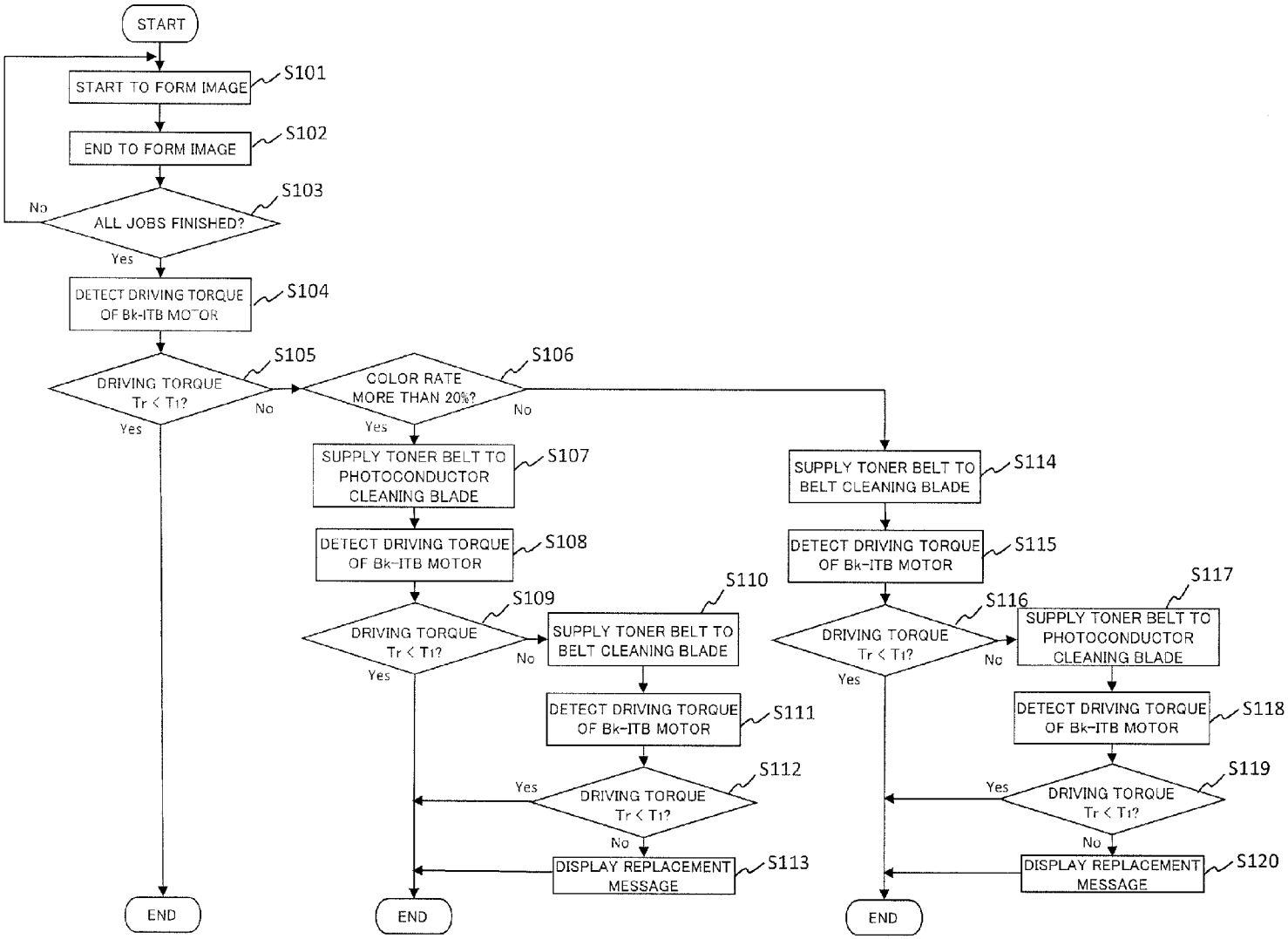
FIG. 5 is a flowchart of processes in supplying the toner belt according to the first embodiment of the present invention.

Next, a control system of the present embodiment will be explained. It is noted that FIG. 2 is a block diagram of the control system executing the supply of the toner belt in the present embodiment, and FIG. 5 is a flowchart concerning processes in supplying the toner belt in the present embodiment.

Figure 2:
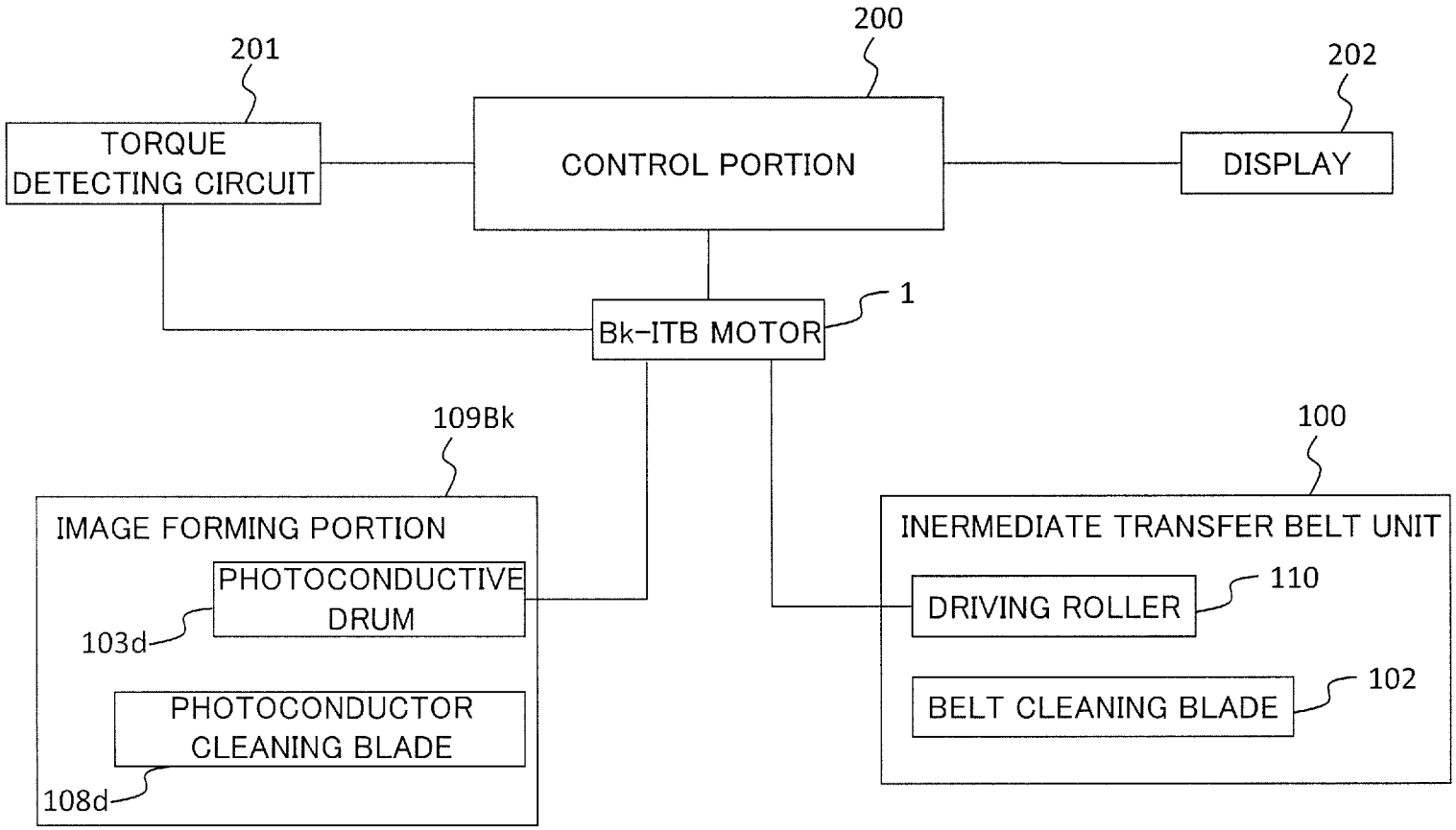
FIG. 2 is a block diagram of a control system executing a toner belt supplying operation of a first embodiment of the present invention.

As shown in FIG. 2, the torque detecting circuit 201, the Bk-ITB motor 1 and a display 202 provided within the apparatus body 70*a* are connected to the control portion 200 including the memory portion 210 (see FIG. 1) composed of the ROM, RAM and others. The display 202 is provided visibly in the apparatus body 70*a* of the image forming apparatus 70. The image forming portion 109Bk also includes the photoconductive drum 103*d* and the photoconductor cleaning blade 108*d*. The intermediate transfer belt unit 100 includes the intermediate transfer belt 101, the driving roller 110 and the belt cleaning blade 102.

It is noted that the control portion 200 of the present embodiment executes the abovementioned control based on processing contents of the most recent predetermined number of times of the image forming operations in the case where the driving torque detected by the torque detecting circuit 201 exceeds a predetermined value. That is, the control portion 200 is configured to be able to execute the lubricant supplying mode of supplying the lubricant to either one of the rubbing portion rB (first rubbing position) and the rubbing portion rd (second rubbing position).

The control portion 200 is capable of executing the full-color mode of forming an image by using the photoconductive drums 103*a* through 103*c*, i.e., the first image carriers, and the photoconductive drum 103*d*, i.e., the second image carrier, and the monochrome mode of forming an image by using only the photoconductive drum 103*d*. Then, the control portion 200 supplies the lubricant to the rubbing portion rd (second rubbing position) in the case where the execution rate of the full-color mode in the most recent predetermined number of times of the image forming operations is greater than a predetermined rate in the lubricant supplying mode. This arrangement makes it possible to supply the lubricant precisely to the required region.

As shown in FIG. 5 (see also FIG. 2), the control portion 200 receives a job and starts to form an image in Step S101. Then, after finishing the image forming operation in Step S102, it is determined whether or not the job is left in Step S103. If the job is left, i.e., No in Step S103 as a result, the control portion 200 returns to Step S101 and continues to form images.

Meanwhile, if it is determined that the entire job has been finished (Yes in Step S103), the control portion 200 controls as follows. That is, the driving torque Tr of the Bk-ITB motor 1 driving the photoconductive drum 103 and the intermediate transfer belt 101 through the driving roller 110 is detected by the torque detecting circuit 201 in Step S104.

Then, the control portion 200 compares the driving torque Tr thus detected with the threshold value $T_1$ set in advance in Step S105. In a case where it is determined that the driving torque Tr is smaller than the threshold value $T_1$ as a result (Yes in Step S105), the control portion 200 stops the image forming apparatus 70. Meanwhile, in a case where it is determined that the driving torque Tr is greater than the threshold value $T_1$ (No in Step S105), the control portion 200 determines whether or not the most recent color rate is 20% or more in Step S106.

In a case where the color rate is greater than 20%, i.e., Yes in Step S106, as a result, the control portion 200 supplies the toner belt formed in the image forming portion 109Bk to the photoconductor cleaning blade 108*d* in Step S107. The driving torque Tr of the Bk-ITB motor 1 is detected further by the torque detecting circuit 201 in Step S108.

After detecting the driving torque Tr in Step S108, the control portion 200 determines whether or not the driving torque Tr thus detected is smaller than the threshold value $T_1$ in Step S109. When the driving torque Tr is smaller than the threshold value $T_1$ as a result, i.e., Yes in Step S109, the control portion 200 stops the image forming apparatus 70.

Meanwhile, in a case where the driving torque Tr is greater than the threshold value $T_1$, i.e., No in Step S109, the control portion 200 supplies the toner belt also to the belt cleaning blade 102 in Step S110. Thus, in the lubricant supplying mode, the following performance is made after supplying the lubricant to either one of the rubbing portions rB (first rubbing position) and rd (second rubbing position). That is, in a case where the driving torque Tr detected by the torque detecting circuit 201 exceeds the threshold value $T_1$, the lubricant is supplied either the other one (the rubbing portion rB. This arrangement makes it possible to precisely supply the lubricant to the required region.

After that, the control portion 200 detects the driving torque Tr of the Bk-ITB motor 1 by the torque detecting circuit 201 in Step S111. After detecting the driving torque Tr in Step S111, the control portion 200 determines whether or not the driving torque Tr thus detected is smaller than the threshold value $T_1$ in Step S112.

In a case where the driving torque Tr is smaller than the threshold value $T_1$ as a result, i.e., Yes in Step S112, the control portion 200 stops the image forming apparatus 70. In a case where the driving torque Tr is greater than the threshold value $T_1$, i.e., No in Step S112, the control portion 200 stops the image forming apparatus 70 after displaying a message urging to replace the process cartridge of the image forming portion 109Bk and the intermediate transfer belt 101 on the display 202 in Step S113.

Meanwhile, in a case where the most recent color rate is less than 20%, i.e., No in Step S106, the control portion 200 supplies the toner belt to the belt cleaning blade 102 in Step S114. After that, the control portion 200 detects the driving torque Tr of the Bk-ITB motor 1 by the torque detecting circuit 201 in Step S115.

After detecting the driving torque Tr in Step S115, the control portion 200 determines whether or not the driving torque Tr thus detected is smaller than the threshold value $T_1$ in Step S116. In a case where the driving torque Tr is smaller than the threshold value $T_1$ as a result, i.e., Yes in Step S116, the control portion 200 stops the image forming apparatus 70.

Meanwhile, in a case where the driving torque Tr is greater than the threshold value $T_1$, i.e., No in Step S116, the control portion 200 supplies the toner belt also to the photoconductor cleaning blade 108*d* in Step S117. After that, the control portion 200 detects the driving torque Tr of the Bk-ITB motor 1 by the torque detecting circuit 201 in Step S118.

After detecting the driving torque Tr in Step S118, the control portion 200 determines whether or not the driving torque Tr thus detected is smaller than the threshold value T1 in Step S119. In a case where the driving torque Tr is smaller than the threshold value T1, as a result, i.e., Yes in Step S119, the control portion 200 stops the image forming apparatus 70.

In a case where the driving torque Tr is greater than the threshold value $T_1$, i.e., No in Step S119, the control portion 200 controls as follows. That is, the control portion 200 stops the image forming apparatus 70 after displaying a message urging to replace the process cartridge of the image forming portion 109Bk and the intermediate transfer belt 101 on the display 202 in Step S120.

It is also possible to arrange such that the supply of the toner belt to the photoconductor cleaning blade 108*d* and the belt cleaning blade 102 and the detection of the driving torque Tr of the Bk-ITB motor 1 are repeated by a plurality of times before displaying the message in Steps S113 and S120.

As described above, the control portion 200 executes the lubricant supplying mode during the post-rotation time performed after finishing the inputted series of jobs, so that the lubricant supplying mode can be executed in a stage in which fluctuation of the torque is stabilized after finishing the process of scraping the transfer residual toner by the cleaning blades.

According to the present embodiment described above, it is possible to supply the toner belt while reducing the wasteful toner consumption by giving priority to the supply of toner to the photoconductor cleaning blade 108*d* and the belt cleaning blade 102 based on the most recent color rate. This arrangement makes it possible to efficiently suppress an occurrence of the chipping and turn-up of the blades.

Second Embodiment

Figure 6:
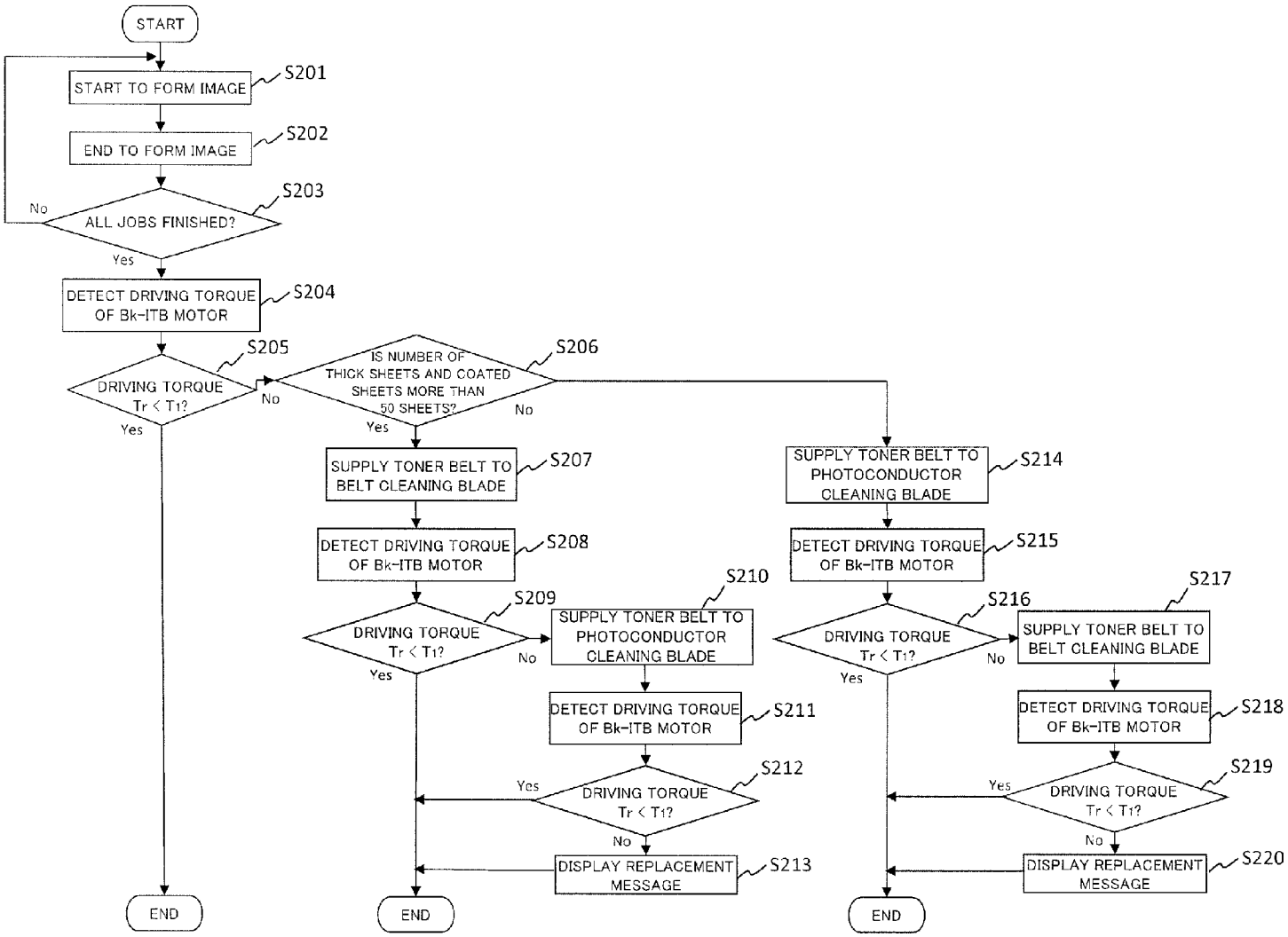
FIG. 6 is a flowchart of processes in supplying the toner belt according to a second embodiment of the present invention.

Next, a second embodiment of the present invention will be explained with reference to FIGS. 2 and 6. It is noted that FIG. 6 is a flowchart concerning processes in supplying the toner belt in the present embodiment.

In the first embodiment described above, the control of the supply of the toner belt carried out by giving the priority to the photoconductor cleaning blade 108*d* and the belt cleaning blade 102 based on the most recent color rate has been explained. However, in the present embodiment, a type of the recording medium P (referred to as 'sheet type' hereinafter) used in a most recent predetermined number of times of the image forming operations performed in the image forming apparatus 70 is adopted as the criteria of the priority. That is, the control portion 200 of the present embodiment controls so as to supply the lubricant to either one of the rubbing portions rB (first rubbing position) and rd (second rubbing position) based on the type of the most recent predetermined number of recording media on which the toner images have been transferred from the intermediate transfer belt 101. This arrangement makes it possible to precisely supply the lubricant to the required region.

While the toner image formed on the intermediate transfer belt 101 is secondarily transferred to the recording medium P at the secondary transfer portion Ts, smoothness is different depending on the type of the sheet used at this time, an amount of the transfer residual toner left on the intermediate transfer belt 101 without being secondarily transferred differs. It is known in general that an amount of transfer residual toner is large in a type of sheet (first recording medium) whose smoothness is low and an amount of the transfer residual toner is small in a type of sheet (second recording medium) whose smoothness is higher than the first recording medium.

In a case where a thick sheet and a coated sheet whose smoothness is high are set as the sheet type, the toner tends to deplete at the rubbing portion rB between the belt cleaning blade 102 and the intermediate transfer belt 101 as compared to a case when a plain sheet and a recycled sheet whose smoothness is low are set as the sheet type. Then, the toner is supplied by giving the priority to the rubbing portion rd of the photoconductor cleaning blade 108*d* in the case where the plain and recycled sheets are more often used in the most recent image forming job. Meanwhile, the toner is supplied by giving the priority to the rubbing portion rB of the belt cleaning blade 102 in a case where the thick and coated sheets are more often used in the most recent image forming job.

Specifically, the control portion 200 determines the priority of the supply of the toner belt to the rubbing portions rB and rd based on a number of used thick and coated sheets in forming images on the most recent 100 sheets in a case where the driving torque Tr of the Bk-ITB motor 1 is greater than the threshold value $T_1$.

In the present embodiment, the priority is given to the rubbing portion rB of the belt cleaning blade 102 in a case where the number of used thick and coated sheets is more than 50 sheets and to the rubbing portion rd of the photoconductor cleaning blade 108*d* in a case where the number of used thick and coated sheets is less than 50 sheets. However, the present invention is noted limited to these specific numerical values and names of the sheets such as the thick and coated sheets.

Here, as shown in FIG. 6 (see also FIG. 2), the control portion 200 receives a job and starts to form an image in Step S201. Then, after finishing the image forming operation in Step S202, it is determined whether or not the job is left in Step S203. If the job is left, i.e., No in Step S203, as a result, the control portion 200 returns to Step S201 and continues to form an image.

Meanwhile, if it is determined that the entire job has been finished, i.e., Yes in Step S203, the control portion 200 detects the driving torque Tr of the Bk-ITB motor 1 commonly driving the photoconductive drum 103 and the intermediate transfer belt 101 by the torque detecting circuit 201 in Step S204.

Then, the control portion 200 compares the driving torque Tr thus detected with the threshold value $T_1$ set in advance in Step S205. In a case where it is determined that the driving torque Tr is smaller than the threshold value $T_1$ as a result, i.e., Yes in Step S205, the control portion 200 stops the image forming apparatus 70. Meanwhile, in a case where it is determined that the driving torque Tr is greater than the threshold value $T_1$, i.e., No in Step S205, the control portion 200 determines whether or not the most recently used number of thick and coated sheets is more than 50 sheets in Step S206.

In a case where the number of used thick and coated sheets is more than 50 sheets, i.e., Yes in Step S206, the control portion 200 supplies the toner belt formed in the image forming portion 109Bk to the belt cleaning blade 102 in Step S207.

The driving torque Tr of the Bk-ITB motor 1 is detected further by the torque detecting circuit 201 in Step S208.

After detecting the driving torque Tr in Step S208, the control portion 200 determines whether or not the driving torque Tr thus detected is smaller than the threshold value $T_1$ in Step S209. In a case where the driving torque Tr is smaller than the threshold value $T_1$ as a result, i.e., Yes in Step S209, the control portion 200 stops the image forming apparatus 70.

Meanwhile, in a case where the driving torque Tr is greater than the threshold value $T_1$, i.e., No in Step S209, the control portion 200 supplies the toner belt also to the photoconductor cleaning blade 108*d* in Step S210. After that, the control portion 200 detects the driving torque Tr of the Bk-ITB motor 1 by the torque detecting circuit 201 in Step S211.

After detecting the driving torque Tr in Step S211, the control portion 200 determines whether or not the driving torque Tr thus detected is smaller than the threshold value $T_1$ in Step S212. In a case where the driving torque Tr is smaller than the threshold value $T_1$ as a result, i.e., Yes in Step S212, the control portion 200 stops the image forming apparatus 70. In a case where the driving torque Tr is greater than the threshold value $T_1$, i.e., No in Step S212, the control portion 200 stops the image forming apparatus 70 after displaying a message urging to replace the process cartridge of the image forming portion 109Bk and the intermediate transfer belt 101 on the display 202 in Step S213.

Meanwhile, in a case where the number of most recently used thick and coated sheets is less than 50 sheets, i.e., No in Step S206, the control portion 200 supplies the toner belt to the photoconductor cleaning blade 108*d* in Step S214. After that, the control portion 200 detects the driving torque Tr of the Bk-ITB motor 1 by the torque detecting circuit 201 in Step S215.

After detecting the driving torque Tr in Step S215, the control portion 200 determines whether or not the driving torque Tr thus detected is smaller than the threshold value $T_1$ in Step S216. In a case where the driving torque Tr is smaller than the threshold value $T_1$ as a result, i.e., Yes in Step S216, the control portion 200 stops the image forming apparatus 70.

Meanwhile, in a case where the driving torque Tr is greater than the threshold value $T_1$, i.e., No in Step S216, the control portion 200 supplies the toner belt also to the belt cleaning blade 102 in Step S217. After that, the control portion 200 detects the driving torque Tr of the Bk-ITB motor 1 by the torque detecting circuit 201 in Step S218.

After detecting the driving torque Tr in Step S218, the control portion 200 determines whether or not the driving torque Tr thus detected is smaller than the threshold value $T_1$ in Step S219. In a case whether the driving torque Tr is smaller than the threshold value $T_1$ as a result, i.e., Yes in Step S219, the control portion 200 stops the image forming apparatus 70.

In a case where the driving torque Tr is greater than the threshold value $T_1$, i.e., No in Step S219, the control portion 200 controls as follows. That is, the control portion 200 stops the image forming apparatus 70 after displaying a message urging to replace the process cartridge of the image forming portion 109Bk and the intermediate transfer belt 101 on the display 202 in Step S220.

It is also possible to arrange such that the supply of the toner belt to the photoconductor cleaning blade 108*d* and the belt cleaning blade 102 and the detection of the driving torque Tr of the Bk-ITB motor 1 are repeated by a plurality of times before displaying the message in Steps S213 and S220.

According to the present embodiment described above, the priority is given to the supply of toner to the photoconductor cleaning blade 108*d* and the belt cleaning blade 102 based on the type of the most recently used sheet. This arrangement makes it possible to supply the toner belt with economy and to suppress an occurrence of the chipping and turn-up of the blades efficiently.

Third Embodiment

Next, a third embodiment of the present invention will be explained with reference to FIGS. 2 and 7. The present embodiment has a configuration of supplying the toner belt by combining the priority based on the most recent color rate of the first embodiment and the priority based on the most recently used type of sheet of the second embodiment. It is noted that FIG. 7 is a flowchart concerning processes in supplying the toner belt in the present embodiment.

Figure 7:
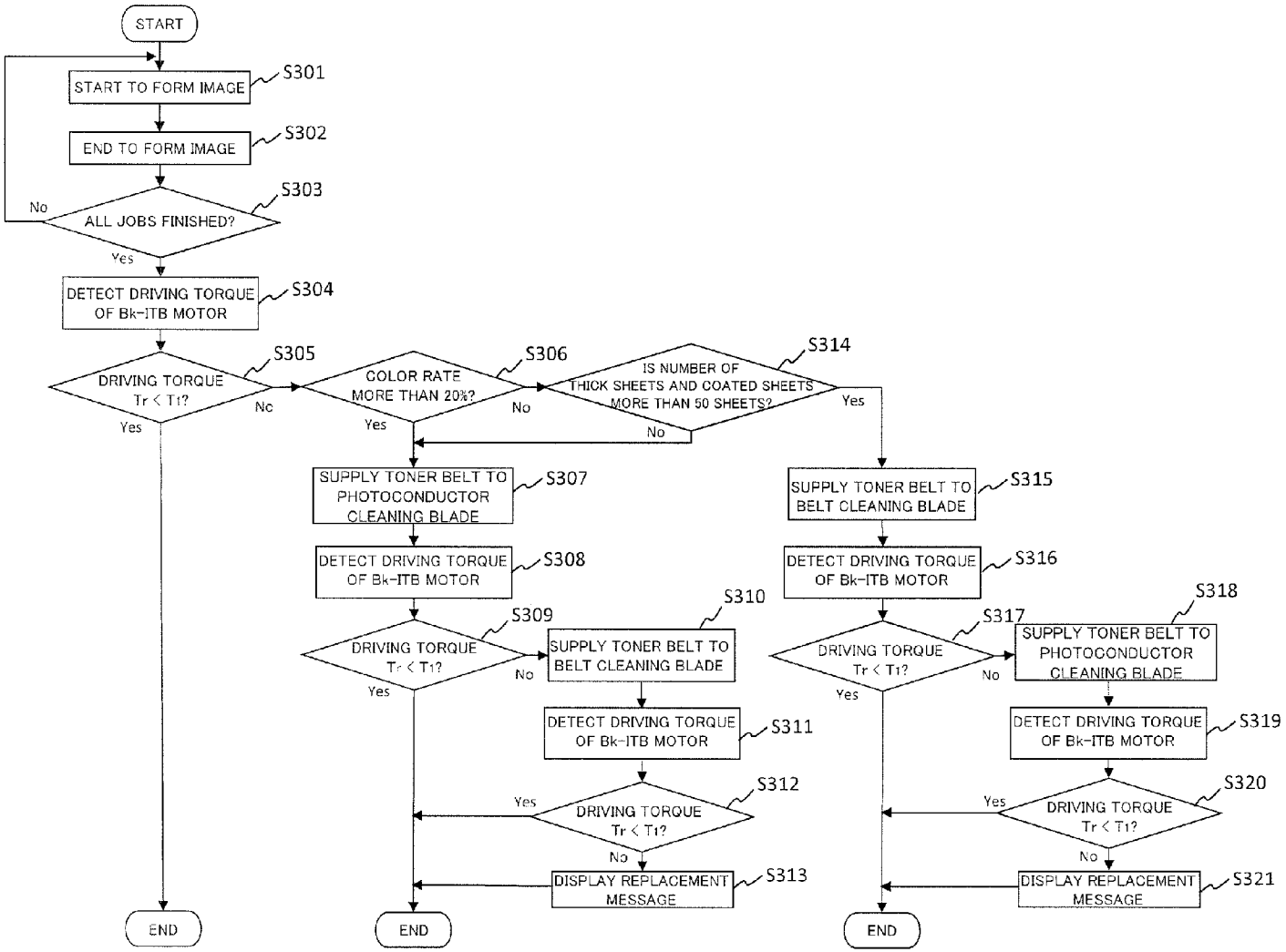
FIG. 7 is a flowchart of processes in supplying the toner belt according to a third embodiment of the present invention.

Here, as shown in FIG. 7 (see also FIG. 2), the control portion 200 receives a job and starts to form an image in Step S301. Then, after finishing the image forming operation in Step S302, it is determined whether or not the job is left in Step S303. If the job is left, i.e., No in Step S303, as a result, the control portion 200 returns to Step S301 and continues to form images.

Meanwhile, if it is determined that the entire job has been finished, i.e., Yes in Step S303, the control portion 200 makes controls as follows. That is, the control portion 200 detects the driving torque Tr of the Bk-ITB motor 1 commonly driving the photoconductive drum 103 and the intermediate transfer belt 101 through the driving roller 110 by the torque detecting circuit 201 in Step S304.

Then, the control portion 200 compares the driving torque Tr thus detected with the threshold value $T_1$ in Step S305. In a case where it is determined that the driving torque Tr is smaller than the threshold value $T_1$ as a result, i.e., Yes in Step S305, the control portion 200 stops the image forming apparatus 70. Meanwhile, in a case where it is determined that the driving torque Tr is greater than the threshold value $T_1$, i.e., No in Step S305, the control portion 200 determines whether or not the most recent color rate is more than 20% in Step S306.

In a case where the color rate is greater than 20%, i.e., Yes in Step S306, as a result, the control portion 200 supplies the toner belt formed in the image forming portion 109Bk to the photoconductor cleaning blade 108*d* in Step S307. The driving torque Tr of the Bk-ITB motor 1 is detected further by the torque detecting circuit 201 in Step S308.

After detecting the driving torque Tr in Step S308, the control portion 200 determines whether or not the driving torque Tr thus detected is smaller than the threshold value $T_1$ in Step S309. When the driving torque Tr is smaller than the threshold value $T_1$ as a result, i.e., Yes in Step S309, the control portion 200 stops the image forming apparatus 70.

Meanwhile, in a case where the driving torque Tr is greater than the threshold value $T_1$, i.e., No in Step S309, the control portion 200 supplies the toner belt also to the belt cleaning blade 102 in Step S310. After that, the control portion 200 detects the driving torque Tr of the Bk-ITB motor 1 by the torque detecting circuit 201 in Step S311.

After detecting the driving torque Tr in Step S311, the control portion 200 determines whether or not the driving torque Tr thus detected is smaller than the threshold value $T_1$ in Step S312. In a case where the driving torque Tr is smaller than the threshold value $T_1$ as a result, i.e., Yes in Step S312, the control portion 200 stops the image forming apparatus 70. In a case where the driving torque Tr is greater than the threshold value $T_1$, i.e., No in Step S312, the control portion 200 stops the image forming apparatus 70 after displaying a message urging to replace the process cartridge of the image forming portion 109Bk and the intermediate transfer belt 101 on the display 202 in Step S313.

In a case where the most recent color rate is lower than 20%, i.e., No in Step S306, the control portion 200 determines whether or not the number of most recently used thick and coated sheets is more than 50 sheets in Step S314. In case where it is determined that the number of used thick and coated sheets is less than 50 sheets, i.e., No in Step S314, the control portion 200 advances to the process from Step S307. Meanwhile, in a case where it is determined that the number of used thick and coated sheets is more than 50 sheets, i.e., Yes in Step S314, the process the control portion 200 advances to Step S315.

The control portion 200 supplies the toner belt to the belt cleaning blade 102 in Step S315. After that, the control portion 200 detects the driving torque Tr of the Bk-ITB motor 1 by the torque detecting circuit 201 in Step S316.

Then, it is determined whether the driving torque Tr thus detected is smaller than the threshold value $T_1$ in Step S317. In a case where the driving torque Tr is smaller than the threshold value $T_1$ as a result, i.e., Yes in 317, the control portion 200 stops the image forming apparatus 70. Meanwhile, in a case where the driving torque Tr is greater than the threshold value $T_1$, No in Step S317, the control portion 200 supplies the toner belt also to the photoconductor cleaning blade 108*d* in Step S318. After that, the control portion 200 detects the driving torque Tr of the Bk-ITB motor 1 by the torque detecting circuit 201 in Step S319.

After detecting the driving torque Tr in Step S319, the control portion 200 determines whether or not the driving torque Tr thus detected is smaller than the threshold value $T_1$ in Step S320. In a case where the driving torque Tr is smaller than the threshold value $T_1$ as a result, i.e., Yes in Step S320, the control portion 200 stops the image forming apparatus 70.

Meanwhile, in a case where the driving torque Tr is greater than the threshold value $T_1$, i.e., No in Step S320, the control portion 200 as follows. That is the control portion 200 stops the image forming apparatus 70 after displaying a message urging to replace the process cartridge of the image forming portion 109Bk and the intermediate transfer belt 101 on the display 202 in Step S321.

It is noted that an arrangement may be made such that the supply of the toner belt to the photoconductor cleaning blade 108*d* and the belt cleaning blade 102 and the detection of the driving torque Tr of the Bk-ITB motor 1 are repeated by a plurality of times before displaying the message in Steps S313 and S321.

The present embodiment described above makes it possible to supply the toner belt without wastefully consuming the toner by giving the priority to the photoconductor cleaning blade 108*d* and the belt cleaning blade 102 based on the most recent color rate and the type of the used sheets. Thereby, it is possible to efficiently suppress an occurrence of the chipping and turn-up of the blades.

Next, a fourth embodiment of the present invention will be explained with reference to FIGS. 8, 9 and 10. The control of assuming the photoconductor cleaning blade 108*d* or the belt cleaning blade 102 to which the toner belt is to be supplied in priority based on the most recent color rate and the type of used sheets has been explained in the first, second and third embodiments. In the present embodiment, however, a method of separating a torque required for driving the photoconductive drum 103 and a torque required for driving the intermediate transfer belt 101 from the driving torque Tr of the Bk-ITB motor 1 will be explained.

Figure 8:
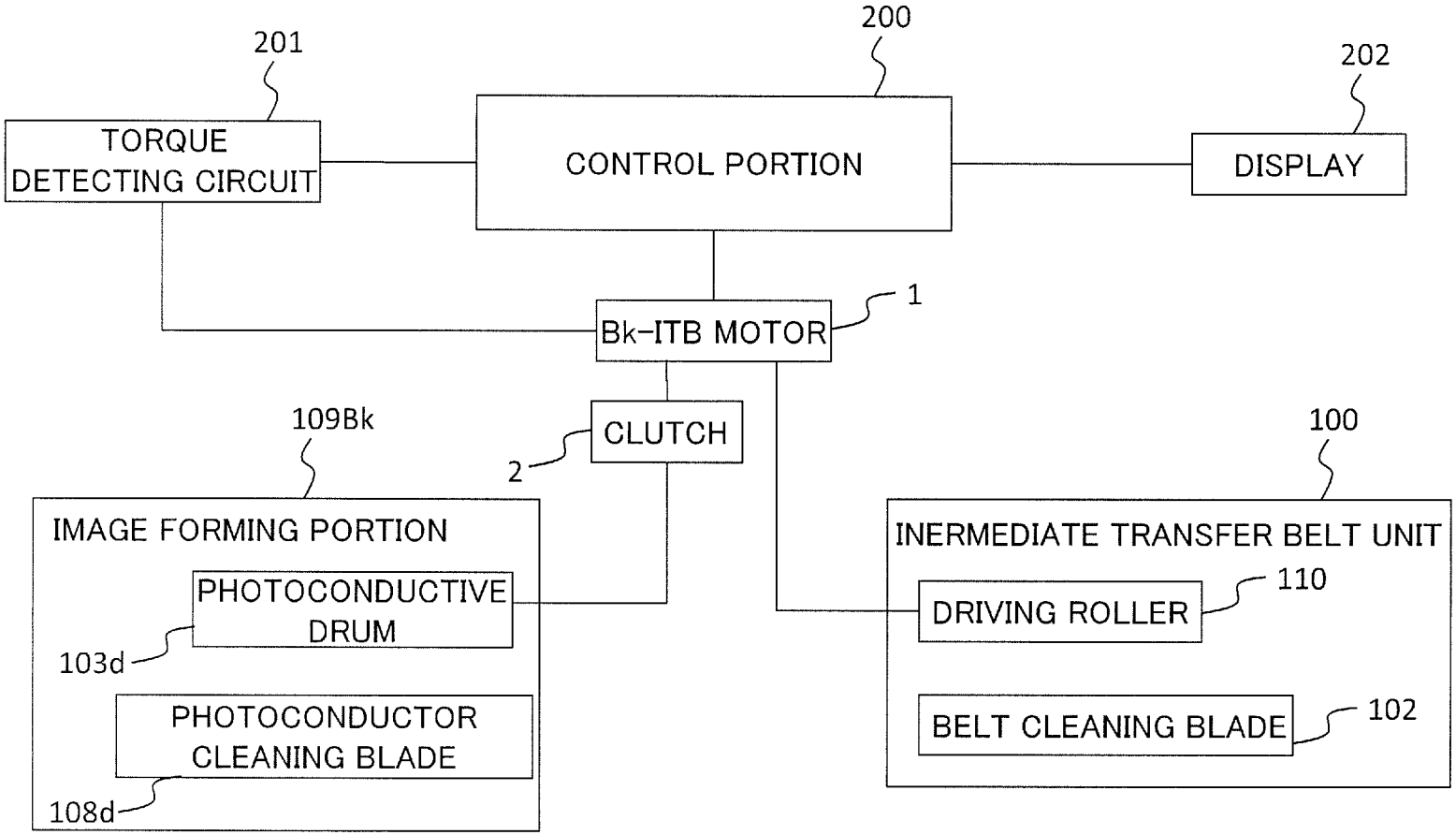
FIG. 8 is a block diagram of a control system executing a toner belt supplying operation of a fourth embodiment of the present invention.
Figure 9:
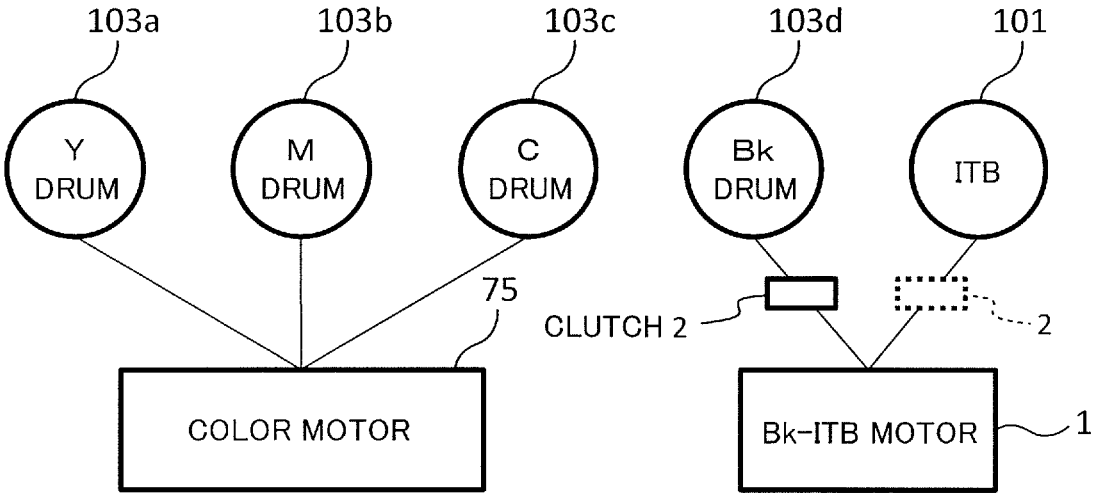
FIG. 9 is a diagram illustrating a configuration in driving the photoconductive drums and the intermediate transfer belt in the fourth embodiment.

As shown in FIGS. 8 and 9, a clutch 2 is disposed between the photoconductive drum 103*d* (Bk drum) and the Bk-ITB motor 1 to make a configuration in which the intermediate transfer belt 101 can be solely driven in the present embodiment. Then, the photoconductive drums 103*a* (Y drum), 103*b* (M drum), 103*c* (C drum) are driven by the common color motor 75 in the same manner with the first through third embodiment.

That is, as shown in FIG. 8 which is a block diagram of a control system executing the supply of the toner belt, the torque detecting circuit 201, the Bk-ITB motor 1 and the display 202 are connected to the control portion 200. The image forming portion 109Bk also includes the photoconductive drum 103*d* and the photoconductor cleaning blade 108*d*. The intermediate transfer belt 101 includes the driving roller 110 and the belt cleaning blade 102. Then, the clutch 2 is disposed between a transmission path of the photoconductive drum 103*d* of the image forming portion 109Bk and the Bk-ITB motor 1.

That is, as shown in FIG. 9, the photoconductive drums 103*a* (yellow photoconductive drum), 103*b* (magenta photoconductive drum), and 103*c* (cyan photoconductive drum) are rotationally driven by the common color motor 75. The photoconductive drum 103*d* (Bk drum) and the intermediate transfer belt 101 (the driving roller 110) are also commonly rotationally driven by the Bk-ITB motor 1. It is noted that the Bk-ITB motor 1 composes a driving source to commonly rotationally drive the intermediate transfer belt 101 and the photoconductive drum 103*d* (second image carrier). Then, this arrangement makes it possible to rotationally drive only the intermediate transfer belt 101 by disconnecting the photoconductive drum 103*d* by turning OFF the clutch 2. At this time, in a case of solely driving the intermediate transfer belt 101, the primary transfer rollers 107*a* through 107*d* corresponding respectively to the photoconductive drums 103*a* through 103*d* and the stretch rollers 113 and 114 are moved to a separate position separating from the intermediate transfer belt 101 by a mechanism not shown.

This arrangement makes it possible to solely drive the intermediate transfer belt 101 by switching the clutch 2 while keeping a simple structure that permits cutting of costs. It is noted that the clutch 2 can be disposed not only between the photoconductive drum 103*d* and the Bk-ITB motor 1 but also between the intermediate transfer belt 101 and the Bk-ITB motor 1, and substantially the same effect can be obtained also in such a case.

According to the present embodiment, the above mentioned arrangement makes it possible to drive the intermediate transfer belt 101 without sliding with the photoconductive drums 103*a* through 103*d*. The driving torque Tr of the Bk-ITB motor 1 is detected by the torque detecting circuit 201 in the state in which the intermediate transfer belt 101 is solely driven by disconnecting the photoconductive drum 103*d* by turning OFF the clutch 2. Thereby, it is possible to precisely determine whether it is necessary to supply the toner belt to the rubbing portion rB between the belt cleaning blade 102 and the intermediate transfer belt 101.

The clutch 2 connects/disconnects the transmission of the drive from the Bk-ITB motor 1 (driving source) to the photoconductive drum 103*d* (second image carrier) in the present embodiment. In a case where the driving torque (driving load) detected by the torque detecting circuit 201 is greater than the threshold value $T_1$ (first predetermined value), the control portion 200 makes controls as follows. That is, the control portion 200 detects the driving torque of the Bk-ITB motor 1 again by the torque detecting circuit 201 in the state in which the photoconductive drum 103*d* is disconnected from the Bk-ITB motor 1 by the clutch 2. Based on the result, the lubricant supplying mode of supplying the lubricant to either one of the rubbing portions rB and rd is executed. This arrangement makes it possible to supply the lubricant more precisely.

In the present embodiment, a threshold value $T_2$ is set with respect to the driving torque Tr of the Bk-ITB motor 1 in solely driving the intermediate transfer belt 101 in the same manner in commonly driving the photoconductive drum 103*d* and the intermediate transfer belt 101.

That is, as described later, the control portion 200 of the present embodiment compares the driving torque detected again by the torque detecting circuit 201 in the state in which the photoconductive drum 103*d* is not driven with the threshold value T2 (second predetermined value) which is smaller than the threshold value $T_1$. Based on that, the control portion 200 supplies the lubricant to either one of the rubbing portions rd (second rubbing position) and rB (first rubbing position). Then, in a case where the driving torque detected again is less than the threshold value T2 (second predetermined value), the control portion 200 supplies the lubricant to the rubbing portion rd (second rubbing position). This arrangement makes it possible to supply the lubricant more precisely.

In a case where the driving torque detected again is greater than the threshold value $T_2$ (second predetermined value), the control portion 200 supplies the lubricant to the rubbing portion rB and then performs as follows in the condition in which the photoconductive drum 103*d* is connected to the Bk-ITB motor 1 by the clutch 2. That is, the control portion 200 detects the driving torque of the Bk-ITB motor 1 further by the torque detecting circuit 201 and in a case where the driving torque thus detected is greater than the threshold value $T_1$ (first predetermined value), the control portion 200 supplies the lubricant to the rubbing portion rd (second rubbing position). This arrangement makes it possible to supply the lubricant more precisely. It is noted the control portion 200 executes the lubricant supplying mode during the post-rotation time after finishing a series of inputted jobs.

The inventors et al. found that the driving torque turned out as follows in a case where toner and external additive, i.e., lubricant, stationarily exists at the rubbing portion rd between the belt cleaning blade 102 and the intermediate transfer belt 101.

That is, the driving torque Tr of the Bk-ITB motor 1 in solely driving the intermediate transfer belt 101 saturated around 0.017 to 0.02 kgf·m (0.166 to 0.196 N/m). The inventors et al. also found that the turn-up of the belt cleaning blade 102 tends to frequently occur when the driving torque Tr of the Bk-ITB motor 1 in solely driving the intermediate transfer belt 101 increases more than 0.03 kgf·m (0.294 N/m).

Then, the threshold value $T_2$ of the driving torque Tr of the Bk-ITB motor 1 in solely driving the intermediate transfer belt 101 will be set at 0.025 kgf·m (0.245 N/m) by considering also chipping of the belt cleaning blade 102 in the present embodiment. However, the present invention is not limited to these specific numerical values.

Next, the process of supplying the toner belt of the present embodiment will be explained with reference to FIG. 10. It is noted that FIG. 10 is a flowchart concerning the process for supplying the toner belt in the present embodiment.

Figure 10:
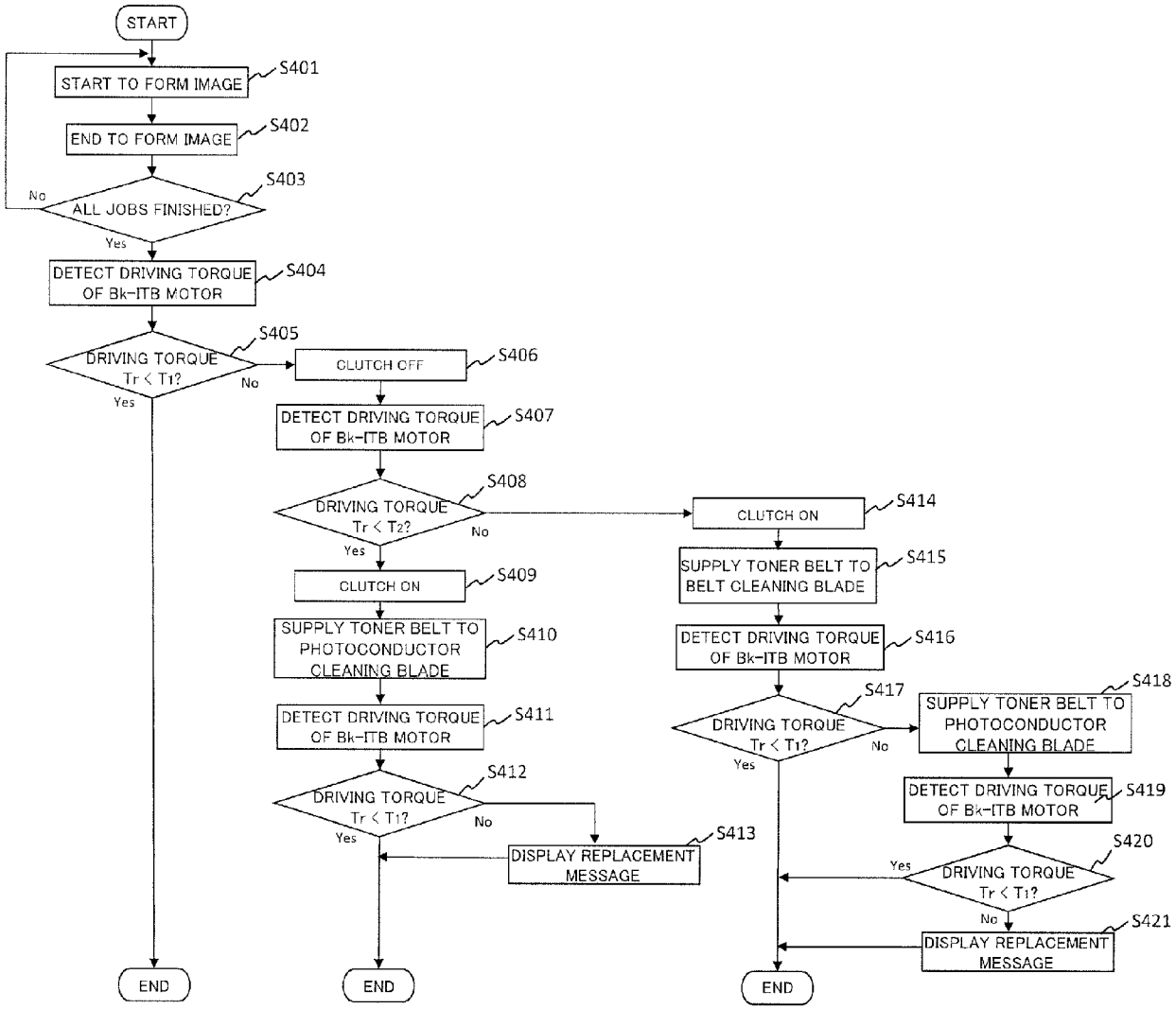
FIG. 10 is a flowchart of processes in supplying the toner belt according to a fourth embodiment of the present invention.

Here, as shown in FIG. 10 (see also FIGS. 8 and 9), the control portion 200 receives a job and starts to form an image in Step S401. Then, after finishing the image forming operation in Step S402, it is determined whether or not the job is left in Step S403. If the job is left, i.e., No in Step S403, as a result, the control portion 200 returns to Step S401 and continues to form an image.

Meanwhile, if it is determined that the entire job has been finished, i.e., Yes in Step S403, the control portion 200 detects the driving torque Tr of the Bk-ITB motor 1 commonly driving the photoconductive drum 103 and the intermediate transfer belt 101 by the torque detecting circuit 201 in Step S404.

Then, the control portion 200 compares the driving torque Tr thus detected with the threshold value $T_1$ set in advance in Step S405. In a case where it is determined that the driving torque Tr is smaller than the threshold value $T_1$ as a result, i.e., Yes in Step S405, the control portion 200 stops the image forming apparatus 70. Meanwhile, in a case where the driving torque Tr is greater than the threshold value $T_1$, i.e., No in Step S405, the control portion 200 turns OFF the clutch 2 (disconnection state) and solely drives the intermediate transfer belt 101 in Step S406. Then, the control portion 200 detects the driving torque Tr of the Bk-ITB motor 1 by the torque detecting circuit 201 in Step S407.

In a case where the driving torque Tr is smaller than the threshold value T2, i.e., Yes in Step S408, as a result, the control portion 200 turns ON the clutch 2 (connection state) and supplies the toner belt formed in the image forming portion 109Bk to the photoconductor cleaning blade 108*d* in Step S410. After that, the control portion 200 detects the driving torque Tr of the Bk-ITB motor 1 further by the torque detecting circuit 201 in Step S411.

In a case where the driving torque Tr is smaller than the threshold value $T_1$, i.e., Yes in Step S412, as a result, the control portion 200 stops the image forming apparatus 70. Meanwhile, in a case where the driving torque Tr is greater than the threshold value $T_1$, i.e., No in Step S412, the control portion 200 stops the image forming apparatus 70 after displaying a message urging to replace the process cartridge of the image forming portion 109Bk and the intermediate transfer belt 101 on the display 202 in Step S413.

Meanwhile, in a case where the driving torque Tr is greater than the threshold value $T_2$, i.e., No in Step S408, the control portion 200 turns ON the clutch 2 (connection state) in Step S414 and supplies the toner belt to the belt cleaning blade 102 in Step S415. After that, the control portion 200 detects the driving torque Tr of the Bk-ITB motor 1 by the torque detecting circuit 201 in Step S416.

After detecting the driving torque Tr in Step S416, the control portion 200 determines whether or not the driving torque Tr thus detected is smaller than the threshold value $T_1$ in Step S417. When the driving torque Tr is smaller than the threshold value $T_1$ as a result, i.e., Yes in Step S417, the control portion 200 stops the image forming apparatus 70.

Meanwhile, in a case whether the driving torque Tr is greater than the threshold value $T_1$, No in Step S417, the control portion 200 supplies the toner belt also to the photoconductor cleaning blade 108*d* in Step S418. After that, the control portion 200 detects the driving torque Tr of the Bk-ITB motor 1 by the torque detecting circuit 201 in Step S419.

After detecting the driving torque Tr in Step S419, the control portion 200 determines whether or not the driving torque Tr thus detected is smaller than the threshold value $T_1$ in Step S420. In a case where the driving torque Tr is smaller than the threshold value $T_1$ as a result, i.e., Yes in Step S420, the control portion 200 stops the image forming apparatus 70.

Meanwhile, in a case where the driving torque Tr is greater than the threshold value $T_1$, i.e., No in Step S420, the control portion 200 stops the image forming apparatus 70 after displaying a message urging to replace the process cartridge of the image forming portion 109Bk and the intermediate transfer belt 101 on the display 202 in Step S421.

It is noted that an arrangement may be made such that the supply of the toner belt to the photoconductor cleaning blade 108*d* and the belt cleaning blade 102 and the detection of the driving torque Tr of the Bk-ITB motor 1 are repeated by a plurality of times before displaying the message in Steps S413 and S421.

The present embodiment described above makes it possible to supply the toner belt without wastefully consuming the toner by providing the torque detecting mode of solely driving the intermediate transfer belt 101. Thereby, it is possible to efficiently suppress an occurrence of the chipping and turn-up of the blades.

Fifth Embodiment

A fifth embodiment of the present invention will be explained with reference to FIGS. 2 and 11. The toner belt supplying sequence has been carried out as the lubricant supplying mode during the post-rotation time after finishing a job in the first through fourth embodiments described above. However, in a case of continuously printing a large number of images which consume less toner, there is a possibility that the photoconductor cleaning blade 108*d* and the belt cleaning blade 102 require the supply of the toner belt during the continuous job.

Then, in the present embodiment, in a case where a continuous job of printing more than a predetermined number of sheets is to be carried out, the job is interrupted once at a predetermined number of sheets to detect the driving torque Tr of the Bk-ITB motor 1. That is, the control portion 200 of the present embodiment executes the lubricant supplying mode by interrupting the process when the number of image formed sheets reaches the predetermined number while executing a series of inputted jobs. This control can be carried out also in the first through fifth embodiments described above in the same manner.

In this control, the supply of the toner belt is carried out in a case where the driving torque Tr thus detected exceeds the threshold value. At this time, the toner belt is supplied by giving the priority to the photoconductor cleaning blade 108*d* and the belt cleaning blade 102 in the same manner with that of the first through fourth embodiments (that is, based on the color rate and the type of the recording medium).

While the job is interrupted when the number of continuously image formed sheets is 100 sheets to detect the driving torque Tr of the Bk-ITB motor 1 in the present embodiment, the present invention is not limited these specific numerical values.

The present embodiment will be explained by exemplifying the case of executing the supply of the toner belt by giving the priority to the photoconductor cleaning blade 108*d* and the belt cleaning blade 102 based on the most recent color rate which has been explained in the first embodiment will be explained with reference to FIGS. 2 and 11. It is noted that FIG. 11 is a flowchart in supplying the toner belt according to the present embodiment.

Figure 11:
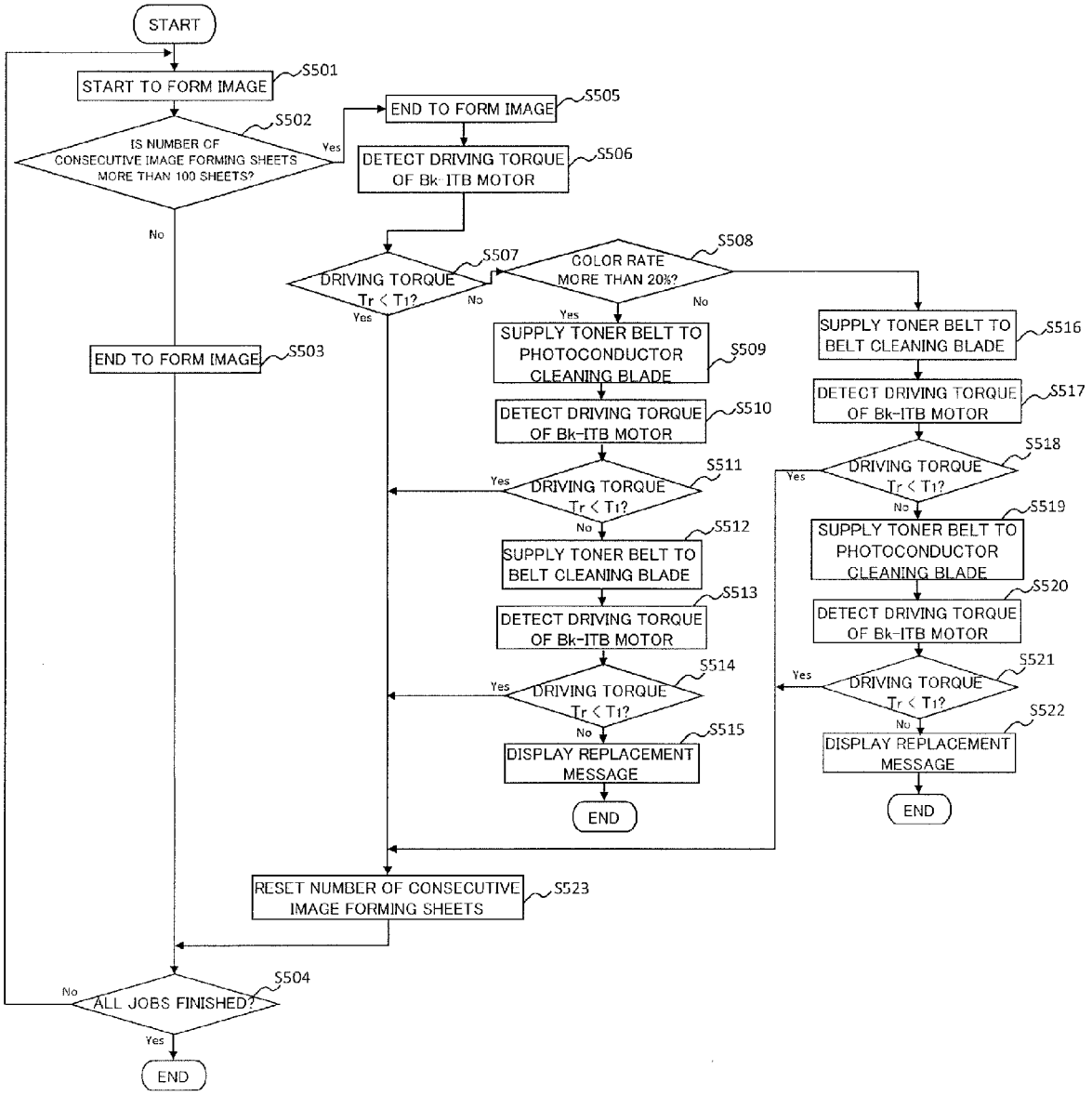
FIG. 11 is a flowchart of processes in supplying the toner belt according to a fifth embodiment of the present invention.

Here, as shown in FIG. 11 (see also FIG. 2), the control portion 200 receives a job and starts to form an image in Step S501. Ina case where a number of consecutive image formed sheets is less than 100 sheets (No in Step S502), the control portion 200 confirms whether or not the job is left after finishing the current image forming job in Step S503 in Step S504. If the job is left (No in Step S504) as a result, the control portion 200 returns to Step S501 and continues to form images. Meanwhile, if the entire job has been finished (Yes in S504), the image forming apparatus 70 is halted.

If the number of the consecutively image formed sheets reaches 100 sheets, i.e., Yes in Step S502, the control portion 200 finishes to form images in Step S505. After that, the control portion 200 detects the driving torque Tr of the Bk-ITB motor 1 driving the photoconductive drum 103 and the intermediate transfer belt 101 by the torque detecting circuit 201 in Step S506.

Then, the control portion 200 compares the driving torque Tr thus detected with the threshold value $T_1$ in Step S507. In a case where it is determined that the driving torque Tr is smaller than the threshold value $T_1$ as a result, i.e., Yes in Step S507, the control portion 200 resets the number of consecutive image formed sheets in Step S523 and advances to Step S504. Meanwhile, in a case where it is determined that the driving torque Tr is greater than the threshold value $T_1$, i.e., No in Step S507, the control portion 200 determines whether or not the most recent color rate is more than 20% in Step S508.

In a case where the color rate is greater than 20%, i.e., Yes in Step S508, as a result, the control portion 200 supplies the toner belt formed in the image forming portion 109Bk to the photoconductor cleaning blade 108*d* in Step S509. After that, the control portion 200 detects the driving torque Tr of the Bk-ITB motor 1 by the torque detecting circuit 201 in Step S510.

Then, the control portion 200 compares the driving torque Tr thus detected with the threshold value $T_1$ in Step S511. In a case where it is determined that the driving torque Tr is smaller than the threshold value $T_1$ as a result, i.e., Yes in Step S511, the control portion 200 resets the consecutive image formed sheets in Step S523 and advances to Step S504. Meanwhile, in a case where it is determined that the driving torque Tr is greater than the threshold value $T_1$, i.e., No in Step S511, the control portion 200 supplies the toner belt also to the belt cleaning blade 102 in Step S512. After that, the control portion 200 detects the driving torque Tr of the Bk-ITB motor 1 by the torque detecting circuit 201 in Step S513.

The control portion 200 compares the driving torque Tr thus detected with the threshold value T1 in Step S514. When it is determined that the driving torque Tr is smaller than the threshold value T1 as a result, i.e., Yes in Step S514, the control portion 200 resets the consecutive image formed sheets in Step S523 and advances to Step S504. Meanwhile in a case where it is determined that the driving torque Tr is greater than the threshold value $T_1$, i.e., No in Step S514, the control portion 200 stops the image forming apparatus 70 after displaying a message urging to relates the image forming portion 109Bk and the intermediate transfer belt 101 on the display 202 in Step S515.

In a case where the most recent color rate is less than 20%, i.e., No in Step S508, the control portion 200 supplies the toner belt to the belt cleaning blade 102 in Step S516. After that, the control portion 200 detects the driving torque Tr of the Bk-ITB motor 1 by the torque detecting circuit 201 in Step S517.

The control portion 200 compares the driving torque Tr thus detected with the threshold value $T_1$ in Step S518. In a case where the driving torque Tr is smaller than the threshold value $T_1$ as a result, i.e., Yes in Step S518, the control portion 200 resets the number of consecutively image formed sheets in Step S523 and advances to Step S504. Meanwhile, in a case where the driving torque Tr is greater than the threshold value $T_1$, i.e., No in Step S518, the control portion 200 supplies the toner belt also to the photoconductor cleaning blade 108*d* in Step S519. After that, the control portion 200 detects the driving torque Tr of the Bk-ITB motor 1 by the torque detecting circuit 201 in Step S520.

Then, the control portion 200 compares whether or not the driving torque Tr thus detected with the threshold value $T_1$ in Step S521. In a case where the control portion determines that the driving torque Tr is smaller than the threshold value $T_1$ as a result, i.e., Yes in Step S521, the control portion 200 advances to Step S523. Meanwhile, in a case where the control portion 200 determines that the driving torque Tr is greater than the threshold value $T_1$, i.e., No in Step S521, the control portion 200 stops the image forming apparatus 70 after displaying a message urging to replace the process cartridge of the image forming portion 109Bk and the intermediate transfer belt 101 on the display 202 in Step S522.

It is noted that an arrangement may be made such that the supply of the toner belt to the photoconductor cleaning blade 108*d* and the belt cleaning blade 102 and the detection of the driving torque Tr of the Bk-ITB motor 1 are repeated by a plurality of times before displaying the message in Steps S515 and S522. Still further, the toner belt may be supplied in the same manner even when the driving torque Tr thus detected exceeds the threshold value $T_1$ by detecting the driving torque Tr of the Bk-ITB motor 1 during the post-rotation time after finishing the entire job.

According to the present embodiment described above, it is possible to supply the toner belt while reducing the wasteful toner consumption by setting the torque detecting mode of detecting the driving torque Tr of the Bk-ITB motor 1 during the consecutive jobs. This arrangement makes it possible to efficiently suppress an occurrence of the chipping and turn-up of the blades.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment (s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No 0.2013-151084, filed on Jul. 19, 2013 which is hereby incorporated by reference herein in its entirety.

What is claimed is:

1. An image forming apparatus comprising:

first and second rotatably supported image carriers;

an intermediate transfer belt rotatably conveying a toner image transferred thereto;

a driving source rotationally driving both the intermediate transfer belt and the second image carrier;

a first cleaning blade rubbing the intermediate transfer belt at a first rubbing position;

a second cleaning blade rubbing the second image carrier at a second rubbing position;

a lubricant supplying portion configured to be able to supply lubricant to the first or second rubbing position;

a load detecting portion configured to detect a driving load of the driving source; and a control portion configured to execute a lubricant supplying mode of supplying lubricant to either one of the first and second rubbing positions on a basis of processing contents of a most recent predetermined number of times of image forming operations in a case where the driving load detected by the load detecting portion exceeds a predetermined value, wherein the control portion is configured to execute a full-color mode of forming an image by using the first and second image carriers and a monochrome mode of forming an image by using only the second image carrier, and supplies the lubricant to the second rubbing position in a case where a most recent execution rate of the full-color mode exceeds a predetermined rate in the lubricant supplying mode.

2. The image forming apparatus according to claim 1, wherein the control portion supplies the lubricant to either one of the first and second rubbing positions on a basis of a most recent type of a predetermined number of recording media on which toner images have been transferred from the intermediate transfer belt.

3. The image forming apparatus according to claim 1, wherein the control portion is configured to transfer a toner image from the intermediate transfer belt to a first recording medium and a second recording medium whose smoothness is higher than that of the first recording medium in the full-color and monochrome modes, and the control portion supplies the lubricant to the second rubbing position in a case where a recording medium used in forming a most recent predetermined number of times of image forming operations is not the second recording medium, regardless whether or not an execution rate of the most recent full-color mode exceeds a predetermined rate, in the lubricant supplying mode.

4. The image forming apparatus according to claim 1, wherein the lubricant is supplied also to the other rubbing position in a case where the driving load detected by the load detecting portion is greater than a predetermined value even if the lubricant is supplied to either one of the first and second rubbing positions in the lubricant supplying mode.

5. The image forming apparatus according to claim 1, wherein the control portion executes the lubricant supplying mode during a post-rotation performed after finishing an inputted series of jobs.

6. The image forming apparatus according to claim 1, wherein the control portion executes the lubricant supplying mode by interrupting a process of a series of inputted jobs when a number of image formed recording media reaches a predetermined number.

7. The image forming apparatus according to claim 1, further comprising:

a first primary transfer portion transferring the toner image formed on the first image carrier to the intermediate transfer belt;

a second primary transfer portion transferring the toner image formed on the second image carrier to the intermediate transfer belt; and a secondary transfer portion transferring the toner images which have been transferred from the first and second image carriers to the intermediate transfer belt to the recording media, wherein the lubricant supplying portion includes a developing unit developing an electrostatic latent image formed on the second image carrier as a toner image, and wherein the control portion applies, in the lubricant supplying mode, voltage with polarity inverse to that of a case where the toner image is transferred from the intermediate transfer belt to the recording medium to the secondary transfer portion in supplying the lubricant to the first rubbing position, and applies voltage with polarity inverse to that of a case where the toner image is transferred from the second image carrier to the intermediate transfer belt to the second primary transfer portion in supplying the lubricant to the second rubbing position.

8. An image forming apparatus comprising:

first and second rotatably supported image carriers;

an intermediate transfer belt rotatably conveying a toner image transferred thereto;

a driving source rotationally driving both the intermediate transfer belt and the second image carrier;

a clutch portion connecting/disconnecting the transmission of the drive from the driving source to either one of the intermediate transfer belt and the second image carrier;

a first cleaning blade rubbing the intermediate transfer belt at a first rubbing position;

a second cleaning blade rubbing the second image carrier at a second rubbing position;

a lubricant supplying portion configured to be able to supply lubricant to the first or second rubbing position;

a load detecting portion configured to detect a driving load of the driving source; and a control portion configured to execute a lubricant supplying mode of, in a case where the driving load detected by the load detecting portion exceeds a first predetermined value, supplying the lubricant to either one of the first and second rubbing positions on a basis of a result obtained by detecting the driving load of the driving source again by the load detecting portion in a state in which either one of the intermediate transfer belt and the second image carrier is disconnected from the driving source by the clutch portion.

9. The image forming apparatus according to claim 8, wherein the control portion supplies the lubricant to either one of the first and second rubbing positions on a basis of a comparison made by comparing the driving load detected again by the load detecting portion in the state in which the second image carrier is not driven with a second predetermined value which is smaller than the first predetermined value.

10. The image forming apparatus according to claim 9, wherein the control portion supplies the lubricant to the rubbing position where the member on a side in which the transmission of power is disconnected by the clutch portion is formed among the first and second rubbing positions in a case where the driving load detected again is less than the second predetermined value.

11. The image forming apparatus according to claim 9, wherein the control portion supplies the lubricant to the first rubbing position in a case where the driving load detected again is greater than the second predetermined value, detects the driving load of the driving source further by the load detecting portion in the state in which the second image carrier is connected with the driving source by the clutch portion, and supplies the lubricant to the second rubbing position in a case where the driving load detected further is greater than the first predetermined value.

* * * * *